US005791183A

United States Patent [19]

Spiegelberg et al.

[11] Patent Number: 5,791,183

[45] Date of Patent: Aug. 11, 1998

[54] APPARATUS AND METHOD FOR COLD FORMING A RING ON A LEAD ALLOY BATTERY TERMINAL INCLUDING AN ANTI-TORQUE STRUCTURE

[75] Inventors: Bernard N. Spiegelberg, Germantown; Dale W. Owens, Milwaukee, both of Wis.

[73] Assignee: Tulip Corporation, Milwaukee, Wis.

[21] Appl. No.: 770,953

[22] Filed: Dec. 20, 1996

Related U.S. Application Data

[63] Continuation-in-part of Ser. No. 443,905, May 17, 1995, Pat. No. 5,632,173.

[51] Int. Cl.[6] ..... B21K 21/08

[52] U.S. Cl. ..... 72/68; 72/125

[58] Field of Search ..... 72/68, 115, 125

[56] References Cited

U.S. PATENT DOCUMENTS

| | | | |
|---|---|---|---|
| 893,018 | 7/1908 | Schoenborn et al. | 72/358 |
| 1,338,462 | 4/1920 | Rydbeck . | |
| 1,668,996 | 5/1928 | Anderson . | |
| 1,766,098 | 6/1930 | Booth . | |
| 1,784,745 | 12/1930 | Nier . | |
| 1,994,178 | 3/1935 | Raiche . | |
| 2,372,011 | 3/1945 | Remington et al. . | |
| 2,392,175 | 1/1946 | Norton . | |
| 2,526,489 | 10/1950 | Liddicoat . | |
| 2,566,243 | 8/1951 | Nyquist . | |
| 2,966,987 | 1/1961 | Kaul . | |
| 2,978,932 | 4/1961 | Frueauff . | |
| 3,186,209 | 6/1965 | Friedman . | |
| 3,280,613 | 10/1966 | Schröm . | |
| 3,712,099 | 1/1973 | Elsbett et al. . | |
| 4,177,665 | 12/1979 | Schurmann . | |
| 4,193,179 | 3/1980 | Confer et al. . | |
| 4,197,772 | 4/1980 | Anderson et al. . | |
| 4,416,141 | 11/1983 | Nippert . | |
| 4,423,617 | 1/1984 | Nippert . | |
| 4,463,590 | 8/1984 | Theobald . | |
| 4,649,731 | 3/1987 | Eisenmann . | |
| 4,653,305 | 3/1987 | Kanamaru et al. . | |
| 4,776,197 | 10/1988 | Scott . | |
| 4,785,649 | 11/1988 | Watanabe et al. . | |
| 4,945,749 | 8/1990 | Walker et al. . | |
| 5,048,590 | 9/1991 | Carter . | |
| 5,077,892 | 1/1992 | Nugent . | |
| 5,296,317 | 3/1994 | Ratte et al. . | |
| 5,349,840 | 9/1994 | Ratte et al. . | |
| 5,425,170 | 6/1995 | Spiegelberg et al. . | |

FOREIGN PATENT DOCUMENTS

| | | |
|---|---|---|
| 0 117 213 | 8/1984 | European Pat. Off. . |
| 5-169183 | 7/1993 | Japan . |
| 902969 | 2/1982 | U.S.S.R. . |

OTHER PUBLICATIONS

FETTE May 1994 Catalog pp. 123–125, 130–134.

*Primary Examiner*—Lowell A. Larson
*Attorney, Agent, or Firm*—Foley & Lardner

[57] ABSTRACT

A method and apparatus utilizing a ring forming head to cold form a ring on a lead battery terminal. The apparatus includes a seating station configured to securely position the lead battery terminal within a fixture. The apparatus further including a rolling head having a plurality of rollers, and a drive system for engaging and rotating the rolling head and lead battery terminal relative to each other. The terminal includes an anti-torque structure formed in the terminal to engage a battery housing at the exterior surface of the housing.

29 Claims, 16 Drawing Sheets

APPARATUS AND METHOD FOR COLD FORMING A RING ON A LEAD ALLOY BATTERY TERMINAL INCLUDING AN ANTI-TORQUE STRUCTURE

CROSS REFERENCE TO RELATED APPLICATIONS

This is a continuation-in-part of U.S. application Ser. No. 08/443,905 filed May 17, 1995, now U.S. Pat. No. 5,632,173.

BACKGROUND OF THE INVENTION

This invention relates generally to an apparatus and method for automated cold forming of a ring on a lead battery terminal.

In general, battery terminals are utilized as an interface between a sealed battery container and an external device seeking electrical power. Battery terminals are typically formed from lead in a cold or hot forming process. In a hot forming process, a lead alloy is heated until it is in a molten state. The molten lead is then poured into a mold or casting and formed into a semi-finished or finished battery terminal. In the cold forming process a lead slug typically at room temperature is subjected to a number of pressing, punching and machining operations in order to create a finished battery terminal.

The hot forming process requires that the lead be heated until it reaches the molten state and then subsequently poured into a mold until it cools. A disadvantage of this method is that it requires the melting of a lead alloy to form the battery terminal. The use of melting for forming terminals may create undesirable porosity.

Existing methods of cold forming a battery terminal from a lead slug require a number of individual steps. In one method a lead slug is first modified in a preform station and then subsequently formed into a finished battery terminal in a final forming press having a split die. Alternatively, in a second method a lead slug is formed into a semi-finished battery terminal in a first station having a split die and then subsequently machined to create a finished battery terminal.

These methods of cold forming a battery terminal require a split die to form the plurality of parallel rings used to prevent movement of the battery terminal along its longitudinal axis. Additionally the split die is used to form the recesses and tabs of the anti-torque ring used to prevent rotation of the terminal about its longitudinal axis.

The method of using a split die to form these rings results in a flash line located on the battery terminal caused by the dividing lines between the portions of the split die. This flash line can result in seepage when the battery terminal is installed in a battery.

Additionally, the recesses and tabs of the anti-torque ring must be angled to permit the removal of the battery terminal from the split die, this results in less than optimal anti-torque properties.

Consequently, it would be desirable to have a battery terminal cold formed from a lead slug that would improve the properties of the anti-torque ring. It would be further desirable to have a battery terminal cold formed from a lead slug without a flash line. It would also be desirable to cold form a battery terminal utilizing a single press.

SUMMARY OF THE INVENTION

The present invention provides a method and apparatus for seating a lead battery terminal within a fixture and forming rings on the lead battery terminal. An embodiment of the apparatus for seating the lead battery terminal includes a fixture having a die provided with a recess configured to receive the battery terminal. The die further includes at least one projection located proximate the recess configured to engage the battery terminal to prevent rotation of the battery terminal within the die.

Another embodiment of the apparatus for forming rings on a lead battery terminal includes a seating station configured to securely position the battery terminal within a fixture. The apparatus further includes a rolling station including a ring forming head. The ring forming head is configured to form rings on the lead battery terminal when the terminal and ring forming head are rotated relative to each other. Additionally, the apparatus includes a drive assembly fastened to the fixture and head to rotate the terminal and ring forming head relative to each other.

An embodiment of the method for forming a ring on a lead battery terminal include the step of securing the lead battery terminal within a fixture. Another step includes engaging a ring forming head with the lead battery terminal while the rolling head and the lead battery terminal are rotating relative to each other.

An embodiment of the battery terminal includes a first portion accessible from the exterior of a battery housing. The terminal further includes a second portion having an engagement structure configured to be molded and contained in a battery housing. The terminal also includes an anti-torque structure formed in the terminal to engage the battery housing at the exterior surface of the housing.

DESCRIPTION OF THE DRAWINGS

FIG. 6B' is an isometric illustration of a partial-finished battery terminal with indents.

DETAILED DESCRIPTION OF THE PREFERRED EMBODIMENT

Figure 1:
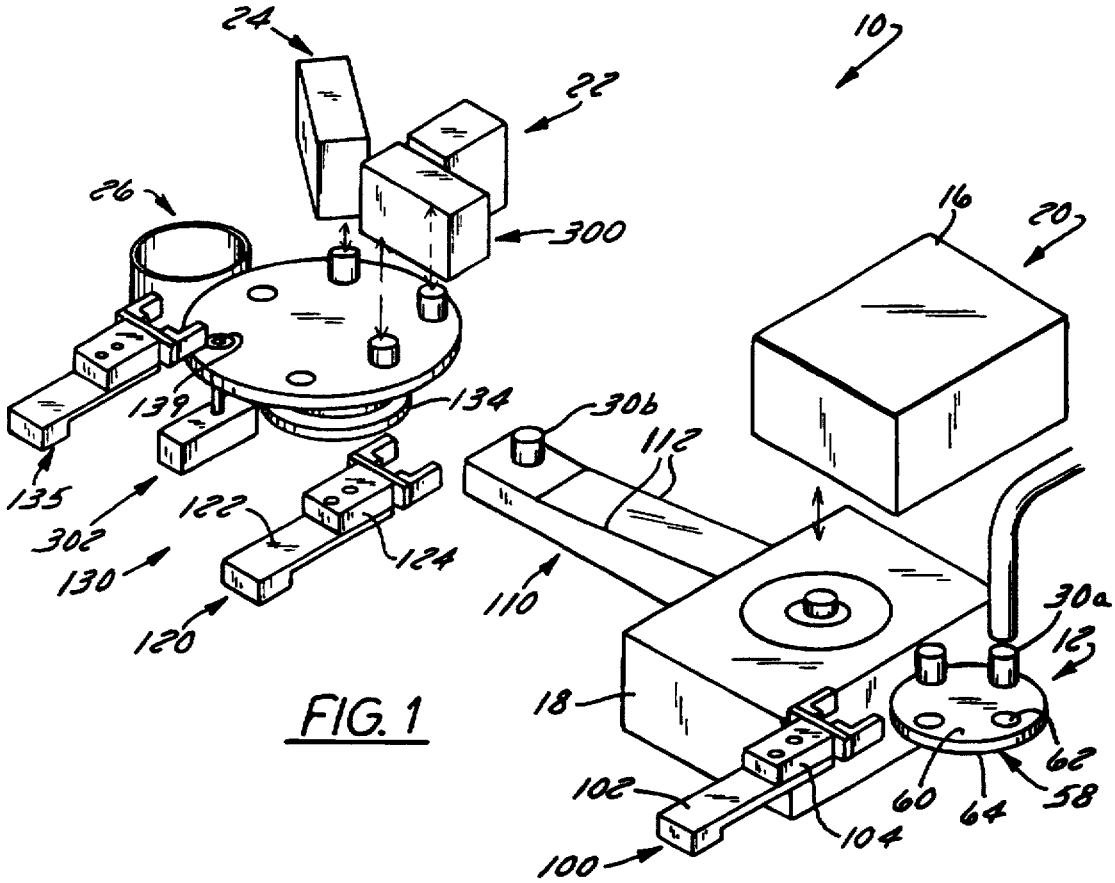
FIG. 1 is a schematic illustration of the lead slug pickup station, forming station, seating station, radial rolling station, through punch station, drop station and transfer mechanisms of the preferred embodiment.

Referring to FIG. 1, a battery terminal forming apparatus 10 includes: a lead slug station 12; a forming station 20; a seating station 300; a radial rolling station 22, a through punch station 24; and an ejection station 302. Additionally, apparatus 10 includes a drop station 26, a first pick and place transfer mechanism 100, a vibratory transfer mechanism 110, a second pick and place transfer mechanism 120, an index assembly 130, and a third pick and place transfer mechanism 135.

Apparatus 10 creates a finished rolled battery terminal **30*d* from a lead slug 30*a*. Lead slug 30*a* including a proximal end 32 and a distal end 34 is first transferred from lead slug station 12 to forming station 20 with first pick and place transfer mechanism 100. In forming station 20 lead slug 30*a* is formed into a partial-finished battery terminal 30*b* including a frustum 50 having a frusto-conical shape, a splined ring 48 having a top surface 304 and a plurality of splined ring recesses 86 and tabs 87, a head 44 having a uniform diameter, and a tapered recess 52 having a blank wall 54**.

Partial-finished battery terminal **30*b* is expelled from forming station 20 and positioned by vibratory transfer mechanism 110 for subsequent transfer by second pick and place transfer mechanism 120 to an index assembly 130 for presentation to seating station 300**.

In seating station 300 partial-finished battery terminal **30*b* is seated within an index die 136 thereby forming partial-finished battery terminal 30*b*' having a plurality of depressions or indents 306. Index assembly 130 is rotatably indexed by an index drive assembly 131 such that partial-finished battery terminal 30*b*' with indents 306 is positioned in radial rolling station 22**.

In radial rolling station 22 partial-finished battery terminal **30*b*' is formed into near-finished battery terminal 30*c* having annular rings 46. Index assembly 130 is next rotatably indexed such that near-finished battery terminal 30*c* is positioned in through punch station 24. Finally, a finished rolled battery terminal 30*d* is formed having a continuous tapered recess 84**.

Referring to FIGS. 1–5, the battery terminal forming apparatus 10 will now be described in greater detail. Lead slug **30*a* is formed and presented in lead slug station 12. Lead slug station 12 includes a transfer mechanism (e.g. guide tube) to transfer lead slug 30*a* to an indexing turntable 58. Indexing turntable 58 includes a circular index plate 60 having a plurality of truncated openings 62. Openings 62 are truncated by a base 64**.

First pick and place transfer mechanism 100 includes an arm 102 and a gripper 104. Lead slug **30*a* is transferred from lead slug station 12 to forming station 20 by activation of arm 102 and gripper 104**.

Figure 2:
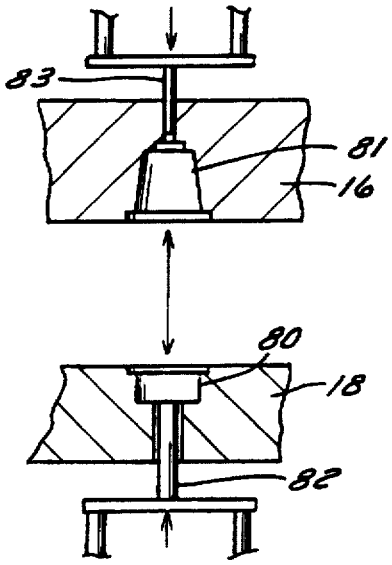
FIG. 2 is a cross-sectional view of the forming station.
Figure 6A:
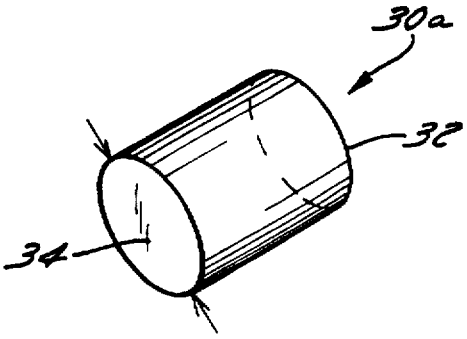
FIG. 6A is an isometric illustration of a lead slug.

As shown in FIG. 2, forming station 20 is a stand alone press including a lower die assembly 18 and an upper die assembly 16. Lower die assembly 18 includes a unitary die 80 and forming punch 82. The lower portion of unitary die 80 includes an inner profile configured to form head 44 having a substantially uniform diameter. The upper portion of unitary die 80 includes an inner profile configured to form a plurality of splined ring recesses 86 and tabs 87 of the partial-finished battery terminal **30*b* (FIG. 6E). In the preferred embodiment splined ring tabs 87 are defined by a first wall 87***a* and a second wall 87*b* which are substantially parallel to one another. In contrast, where an apparatus uses a split die to form a battery terminal the walls of some splined ring tabs must be angled to permit the opening of the split die (FIG. 6F).

Upper die assembly 16 includes a forming cavity 81 in alignment with forming punch 82. Forming cavity 81 includes an upper tapered region and a lower portion which respectively forms frustum 50, and an upper region of splined ring 48 of partial-finished battery terminal 30*b*. Upper die assembly 16 further includes a release punch 83 having a release punch end. Forming cavity further includes a cylindrical portion located above the upper tapered region which forms a chimney 40 on partial-finished battery terminal 30*b*.

Referring to FIG. 1 vibratory transfer mechanism 110 includes side walls 112 which are spaced apart a distance less than the diameter of splined ring 48. Side walls 112 are angled downward and are vibrated to translate partial-finished battery terminal 30*b* toward the end of side walls 112.

Referring to FIG. 1 second transfer pick and place mechanism 120 includes an arm 122 and a gripper 124 for transferring partial-finished battery terminal 30*b* from vibratory transfer mechanism 110 to a fixture or an index assembly 130.

Figure 4:
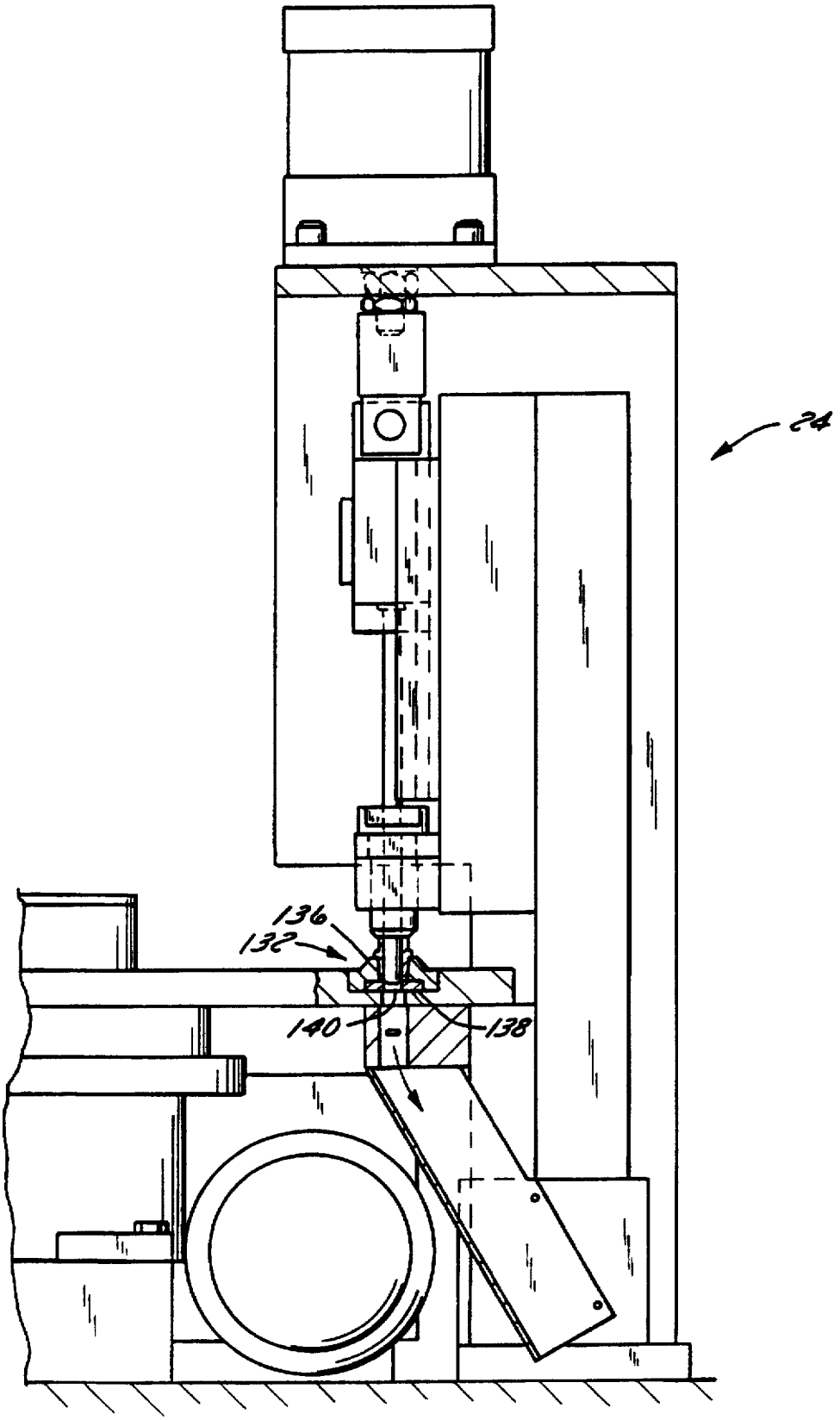
FIG. 4 is a cross-sectional view of the through punch station.
Figures 5, 5A, 5B:
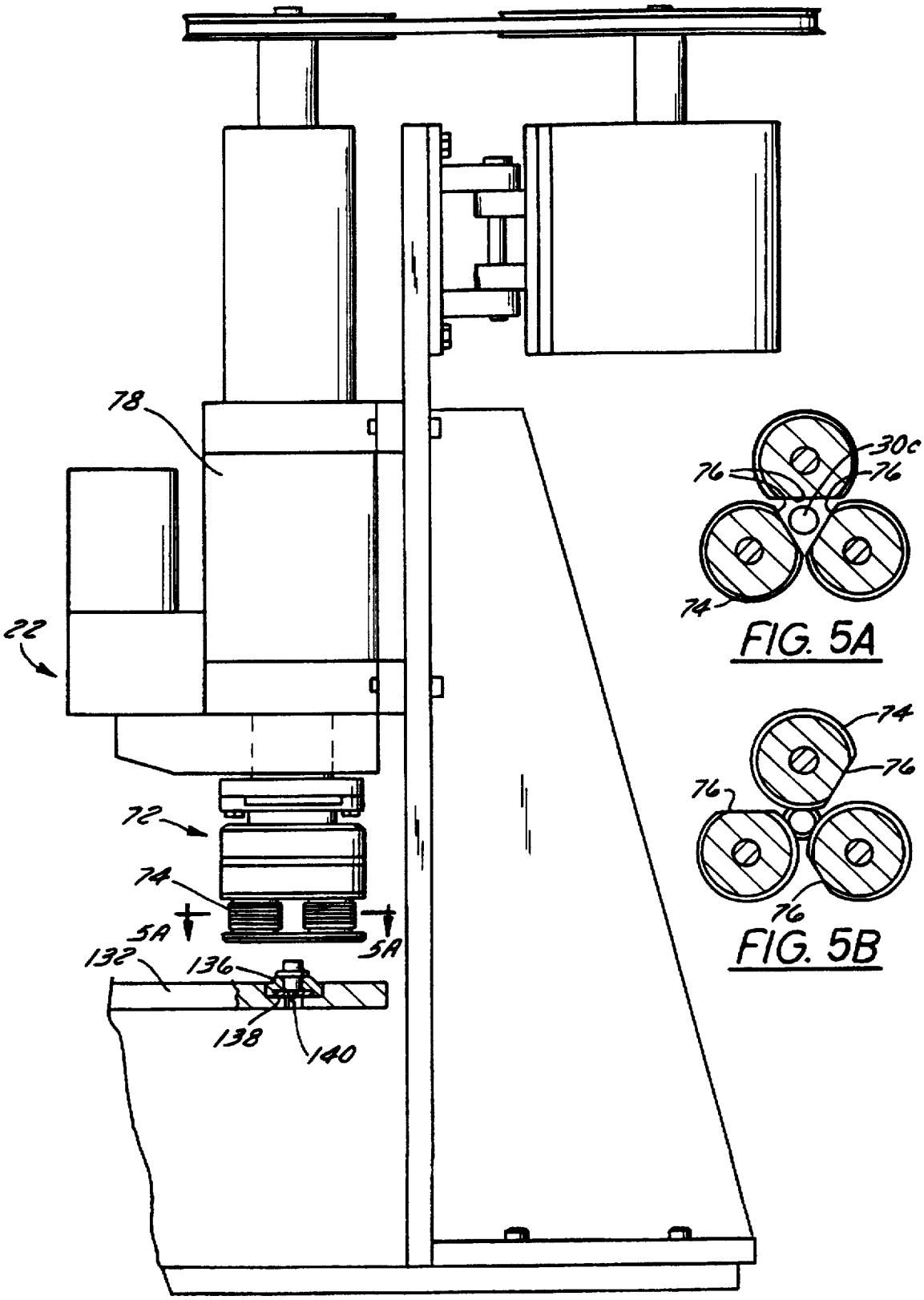
FIG. 5 is a cross-sectional view of the radial rolling head station.
FIG. 5A is a cross-sectional view taken along line 5A—5A of the rollers of the radial rolling head station.
FIG. 5B is a cross-sectional view of the rollers of the radial rolling head station in the engaged position.

As shown in FIGS. 1, 4 and 5 index assembly 130 includes a circular index plate 132 mounted for rotary motion on a base 134. Circular index plate 132 includes a plurality of index dies 136.

Figure 11:
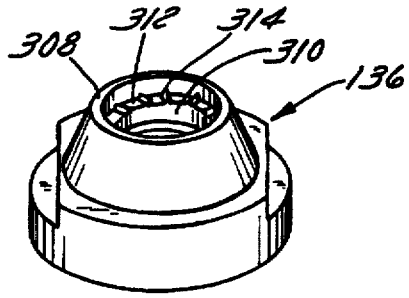
FIG. 11 is an isometric view of an index die.
Figure 14:
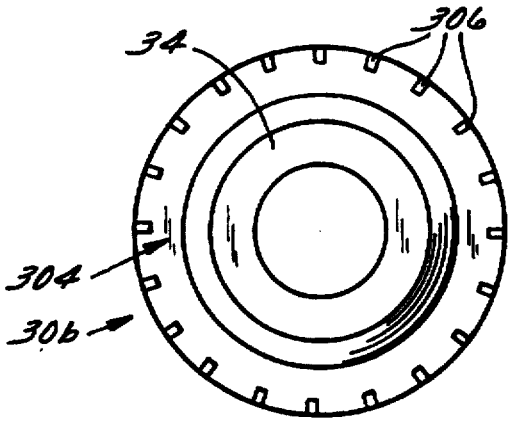
FIG. 14 is a top view of the partial-finished battery terminal with indents.

As illustrated in FIG. 11 each index die 136 includes a top surface 308, and an internal cavity 310 configured to receive partial finished battery terminal 30*b*. Index die 136 includes a radial surface 312 having a plurality of uniformly spaced projections or barbs 314 extending therefrom. Each barb 314 includes a barb tip 316 distal from radial surface 312. In the preferred embodiment there are a total of 20 barbs 314, each barb located approximately every 18 degrees. However, it may be possible to utilize a single projection or barb 314. In the preferred embodiment barb 314 has a triangular cross section, however barb 314 may have other shapes as well, such as rectangular or conical. Barbs 314 may have a tapered form, such that the cross section of barb 314 has an area greater at radial surface 312 than at barb tip 316. However, barbs 314 may have a uniform cross section. The tapered cross section aids in the formation of indents 306.

In the preferred embodiment radial surface 312 is located 0.045 inches from top surface 308, and each barb 314 extends 0.035 inches from radial surface 312 toward top surface 308. However, other distances may be utilized as well.

Figure 13:
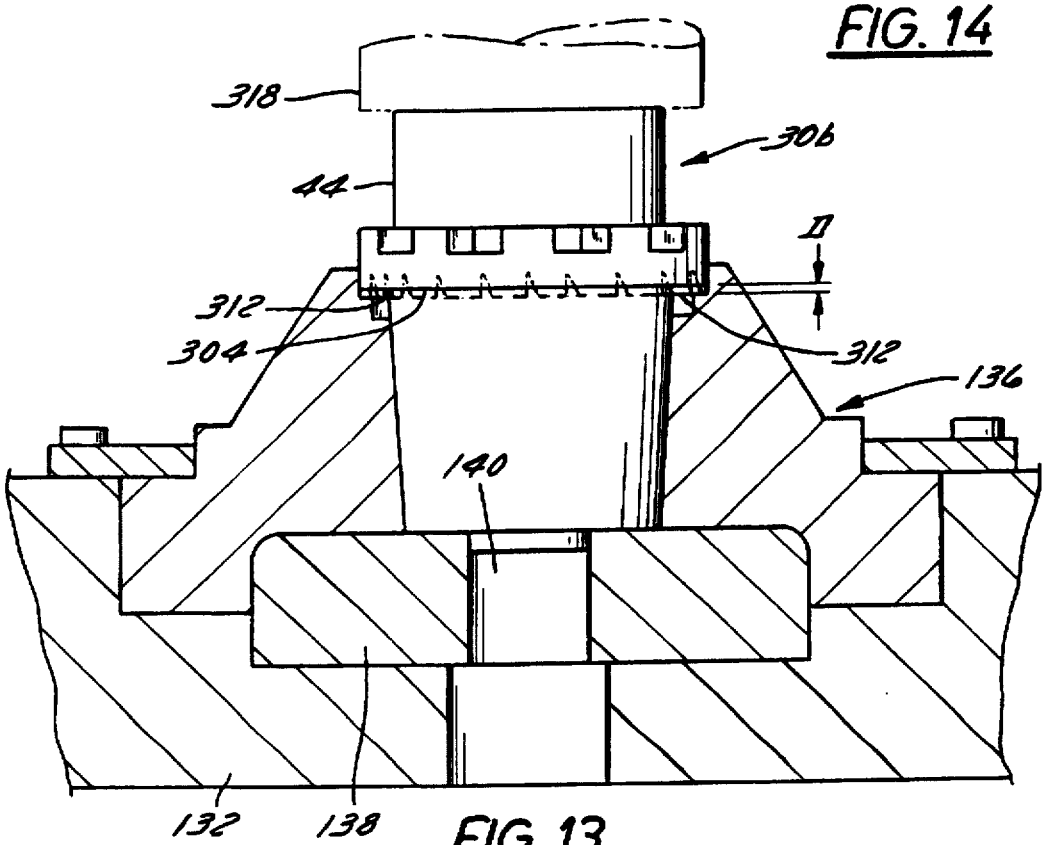
FIG. 13 is a cross sectional view of an index die and a partial-finished battery terminal seated within the index die.

As shown in FIGS. 4 and 13 circular index plate 132 further includes an anvil 138 having an opening 140 located at the base of each index die 136. Anvil 138 is configured to support proximal end 32 of partial-finished battery terminal 30*b*.

Seating station 300 is mounted in overhanging relationship to the edge of circular index plate 132. Seating station 300 includes a moveable seating punch 318 having a diameter greater than head 44.

As shown in FIG. 5 radial rolling station 22 includes a drive assembly 78, a ring forming head 72 having three rollers 74 configured to form annular rings 46 on partial-finished battery terminal 30*b*'. Each roller 74 includes a flat portion 76 (FIG. 5A). Ring forming head 72 is mounted in overhanging relationship to the edge of circular index plate 132. Ring forming head 72 is further situated in alignment with index die 136 permitting engagement of ring forming head 72 with head 44 of partial-finished battery terminal 30*b*'. In this embodiment ring forming head 72 is of the type manufactured by Fette type Radial Rolling Head E 16 A 00 having three rollers 74 configured to create annular rings 46.

Through punch station 24 is mounted in overhanging relationship to the edge of circular index plate 132. Through punch station 24 includes a through punch 92 aligned with the opening 140 of anvil 138.

As illustrated schematically in FIG. 1, ejection punch station 302 is located beneath circular index plate 132. Ejection punch station 302 includes an ejection punch 139 configured to raise a finished rolled battery terminal from index die 136.

The method of creating a finished battery terminal utilizing apparatus 10 as described above will now be described in greater detail. An elongated cylindrical lead slug 30*a* is first formed (e.g. cut or sheared) from an extruded lead wire 98 in lead slug station 12. Lead slug 30*a* includes proximal end 32, and distal end 34 (FIG. 6A). Lead slug 30*a* is transferred from lead slug station 12 by means of a transfer mechanism (e.g. guide tube) to indexing turntable 58. Lead slug 30*a* is received in opening 62 where proximal end 32 is supported by base 64. Indexing turntable 58 is rotatably indexed to permit lead slugs 30*a* to be removed by first pick and place transfer station 100.

Arm 102 and gripper 104 of first pick and place transfer station 100 transfers lead slug 30*a* from indexing turntable 58 to forming station 20 and places lead slug proximal end 32 in contact with lower die assembly 18 directly below forming cavity 81. When forming station 20 is cycled, upper die assembly 16 and lower die assembly 18 come together. Forming punch 82 is subsequently activated extending from lower die assembly 18 into upper die assembly 16 within forming cavity 81.

Figure 6B:
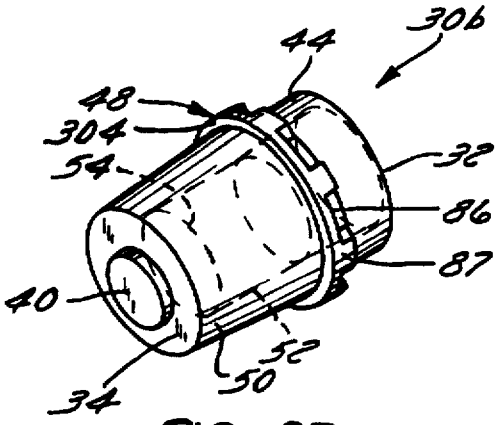
FIG. 6B is an isometric illustration of a partial-finished battery terminal.
Figure 6B:
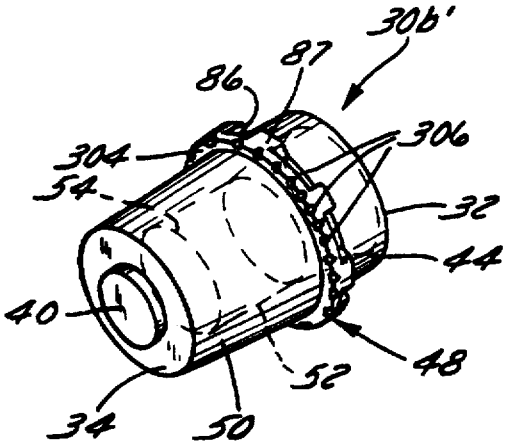
Figure 6D:
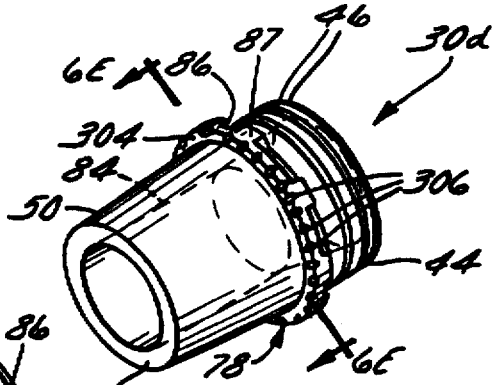
FIG. 6D is an isometric illustration of a rolled battery terminal.

In this manner partial-finished battery terminal 30*b* is formed including frustum 50, head 44 having a substantially uniform diameter, and a splined ring 48 having a top surface 304 and a plurality of splined ring recesses 86 and tabs 87, (FIG. 6B). Additionally, the partial-finished battery terminal 30*b* includes a tapered recess 52 extending from proximal end 32 toward distal end 34 and concluding at a blank wall 54. Frustum 50 further includes a chimney 40 which causes partial-finished battery terminal 30*b* to remain in the upper die assembly 16 as the upper die assembly 16 and lower die assembly 18 separate.

Partial-finished battery terminal 30*b* is subsequently expelled by activation of release punch 83. As partial-finished battery terminal 30*b* is released from upper die assembly 16, it is expelled out of forming station 20 by means of a timed blast of compressed air.

Partial-finished battery terminal 30*b* is deposited in vibratory transfer mechanism 110 where the partial-finished battery terminal 30*b* is orientated between side walls 112 such that head 44 is facing up and presented for transfer by second transfer mechanism 120. Arm 122 and gripper 124 of second transfer station transfers partial-finished battery terminal 30*b* from vibratory transfer mechanism 110 to index die 136 such that head 44 is face up and top surface 304 of spline 48 is resting on tips 316 of barbs 314. In this position frustum 50 is located within index die 136.

Circular index plate 132 is indexed such that partial-finished battery terminal 30*b* is aligned with seating station 300. When seating station 300 is activated seating punch 318 forces top surface 304 of spline 48 onto barbs 314 thereby forming indents 306. Seating punch 318 forces battery terminal 30*b* into index cavity 310 until distal end 34 is in contact with anvil 138. In this fully seated position barbs 314 are only partially located within spline 48. A gap D remains between top surface 304 of spline 48 and radial surface 312 of index die 136 (FIG. 13). Gap D is to ensure that distal end 34 is in substantial contact with anvil 138.

In this manner a plurality of uniformly spaced indents 306 are formed and the resulting partial-finished battery terminal 30*b'* is securely seated in index die 136. Partial-finished battery terminal 30*b'* is thereby prevented from rotating within index die 136 during subsequent rolling operations.

In the preferred embodiment seating punch 318 is formed from a plastic material, however other material maybe utilized as well. Additionally, seating punch 318 is air activated with approximately 90 psi of pressure. However punch 318 may be applied by other mechanical means as well. Additionally, the force required to form the indents and seat the terminal however may vary depending on the size and configuration of the barbs. In this manner a partial-finished battery terminal 30*b'* with indents 306 is formed. (FIG. 6B').

Figure 6C:
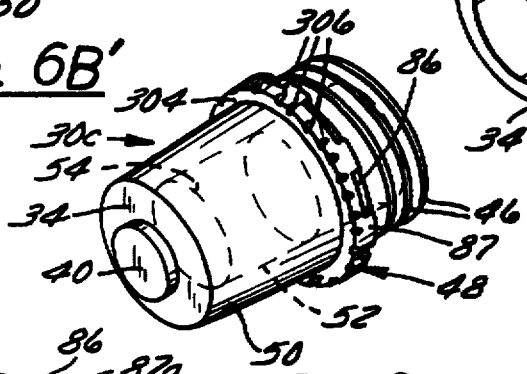
FIG. 6C is an isometric illustration of a near-finished battery terminal.
Figure 6E:
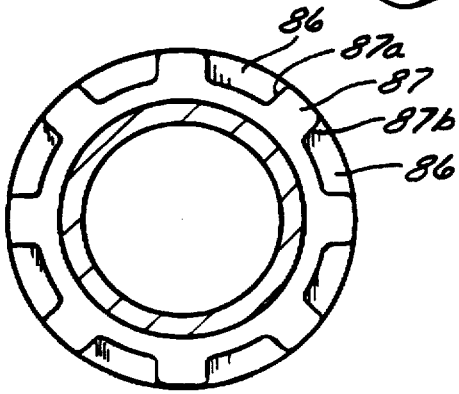
FIG. 6E is a cross-sectional view taken along line 6E—6E of the splined ring of the rolled battery terminal.
Figure 6F:
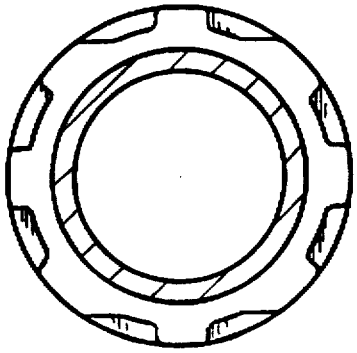
FIG. 6F is a cross-sectional view of a splined ring of a prior art battery terminal.

Circular index plate 132 is subsequently indexed such that partial-finished battery terminal 30*b'* is aligned with radial rolling head station 22. When radial rolling head station 22 is activated ring forming head 72 engages head 44. Rollers 74 are initially positioned such that flat portion 76 of rollers 74 are facing head 44 (See FIG. 5A). Ring forming head 72 is rotated by drive assembly 78 such that rollers 74 are rotated once thereby engaging head 44 and cold forming annular rings 46 (See FIG. 5B). The diameter of head 44 of the near-finished battery terminal 30*c* is modified as a result of the engagement and rotation of the ring forming head 72. Annular rings 46 are formed not by removing material from head 44 but rather by the flowing of material. At the completion of the rotation the flat portions 76 of rollers 74 are facing head 44 permitting the disengagement of ring forming head 72 at the end of the cycle. In this manner a near-finished battery terminal 30*c* is formed having annular rings 46 (FIG. 6C). The engagement of indents 306 on barbs 314 act to prevent rotation of terminal 30*b'* with respect to index die 136 during the rolling operation.

In contrast to a battery terminal formed with a split die, the near-finished battery terminal 30*c* is formed without a flash line along the longitudinal axis of the battery terminal.

Circular index plate 132 is subsequently indexed such that near-finished battery terminal 30*c* is aligned with through punch station 24. When through punch station 24 is activated through punch 92 removes chimney 40 and a disc 56 from blank wall 54 forming a continuous tapered recess 84 extending from proximal end 32 to distal end 34. In this manner a finished rolled battery terminal 30*d* is formed. (FIG. 6D). The punching of disc 56 from blank wall 54 to form continuous tapered recess 84 is conducted after the radial rolling operation to prevent partial-finished battery terminal 30*b'* from becoming free from barbs 314 during the rolling operation.

Circular index plate 132 is next indexed such that finished rolled battery terminal 30*d* is aligned with ejection station 302. Ejection punch 139 is activated and raises finished rolled battery terminal 30*d* from index die 136. Transfer mechanism 135 subsequently transfers finished rolled battery terminal 30*d* to drop station 26.

Figure 3:
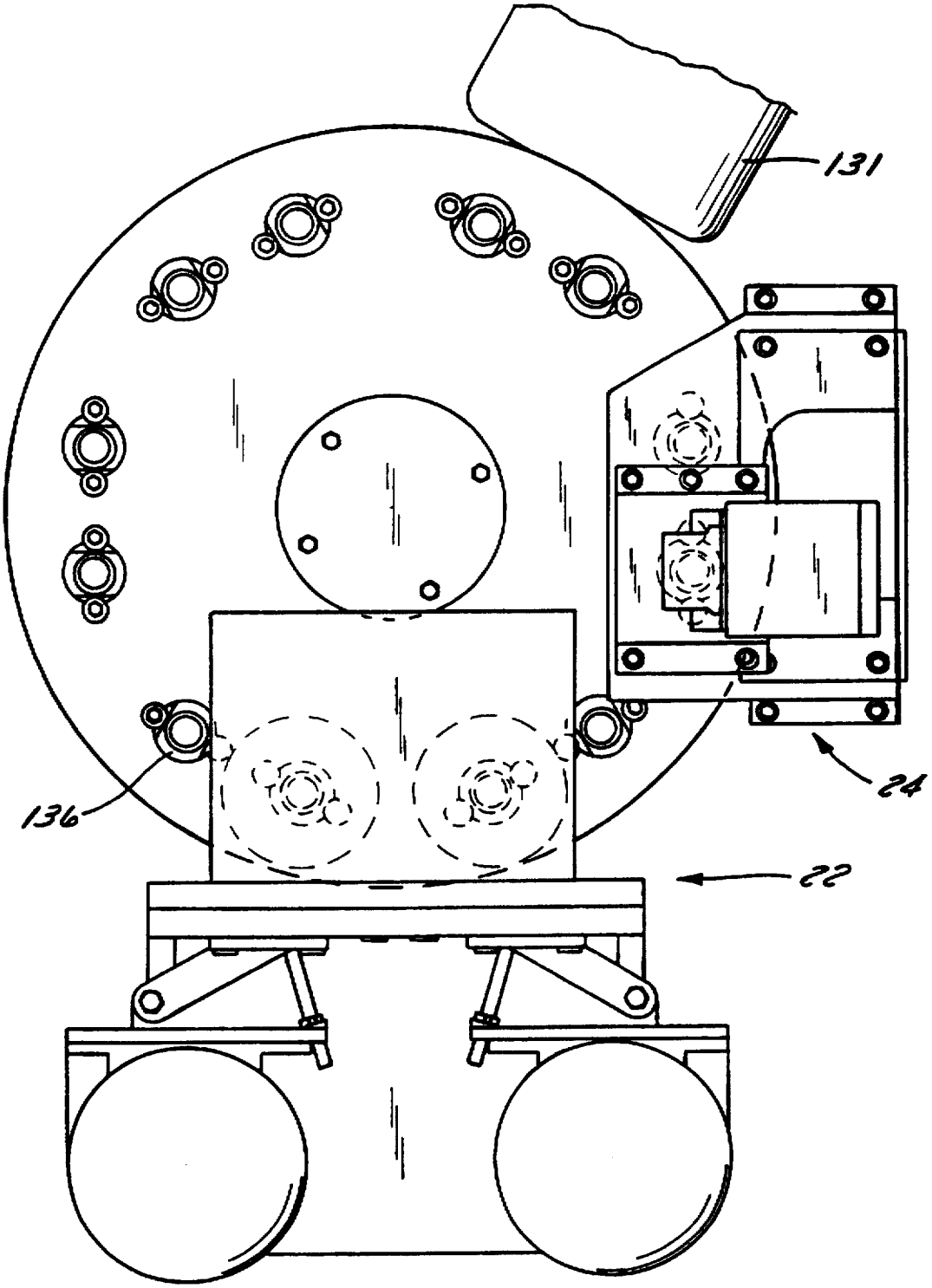
FIG. 3 is a planar view of an indexing turntable.

In one embodiment illustrated in FIG. 3 apparatus 10 includes two radial rolling stations 22 and two through punch stations 24 located about circular plate 132. Radial rolling stations 22 and through punch stations 24 are activated in such a manner as to increase the manufacturing rate of apparatus 10. However any number of stations may be included about circular plate 132. FIG. 3 is exemplary and only illustrates radial rolling stations 22 and through punch station 24. Although not shown, two seating stations and two ejection stations would be included as well.

Figure 7:
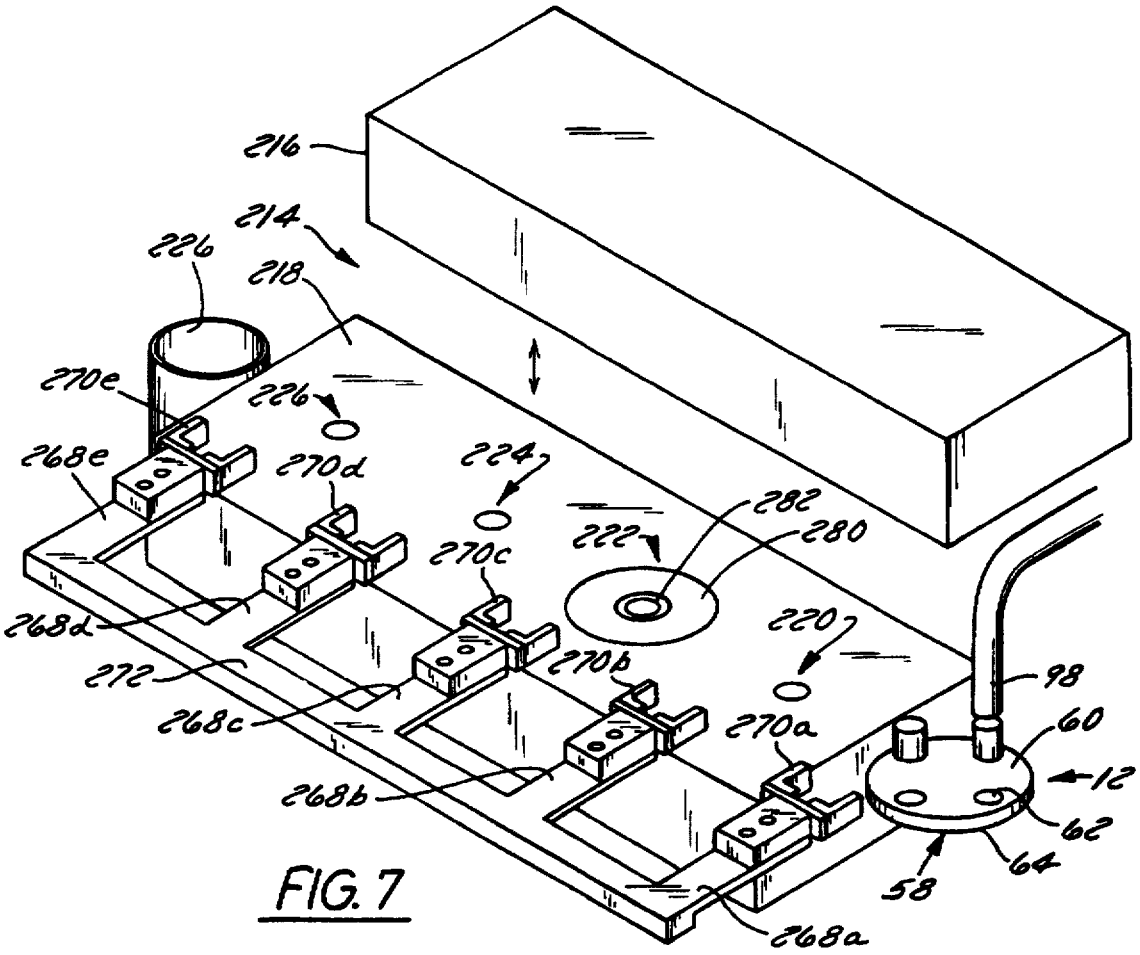
FIG. 7 is a schematic illustration of the lead slug pickup station, progressive die stations, drop station and transfer mechanism of the alternative embodiment.

Referring to FIG. 7, an alternative embodiment of a battery forming apparatus 210 will now be described. Automated battery terminal forming apparatus 210 includes a lead slug station 12, a press structure and system (not shown) provided with a progressive die 214 having an upper die assembly 216 and a lower die assembly 218. Progressive die 214 includes four stations: a preform station 220; a partial-finish station 222; a near-finish station 224; and a rolling station 226. The automated battery terminal forming apparatus 210 further includes a drop station 26 and a five arm transfer mechanism 228.

Apparatus 210 automatically creates a rolled battery terminal 230*e* from a lead slug 230*a*. Transfer mechanism 228 simultaneously indexes lead slugs 230*a* from one station to the next with each cycle of progressive die 214. In preform station 220 lead slug 230*a* is formed into a pre-formed lead slug 230*b* having a lead slug preform cavity 238. Next, in partial-finish station 222 preformed lead slug 230*b* is formed into a partial-finished battery terminal 230*c* including a frustum 250 having a frusto-conical shape, a splined ring 248 having a plurality of recesses 286 and tabs 287, a head 244 having a uniform diameter, and a tapered recess 252 having a blank wall 254.

Subsequently, in near-finish station 224 partial-finished battery terminal 230*c* is formed into a near-finished battery terminal 230*d* having a through hole defined by a continuous tapered recess 252. Finally in rolling station 226 near-finished battery terminal 230*d* is formed into a rolled battery terminal 230*e* having annular rings 246.

Referring to FIGS. 7–10, this alternative embodiment will be described in greater detail. Lead slug station 12 includes a transfer mechanism (e.g. guide tube) to transfer lead slug 230*a* to an indexing turntable 58. Indexing turntable 58 is provided with a circular index plate 60 having a plurality of truncated openings 62. Openings 62 are truncated by a base 64.

Referring to FIG. 7 transfer mechanism 228 is provided with five transfer arms 268*a*, 268*b*, 268*c*, 268*d* and 268*e* which extend normally from a base member 272. Transfer arms 268*a*, 268*b*, 268*c*, 268*d* and 268*e* are respectively provided with grippers 270*a*, 270*b*, 270*c*, 270*d* and 270*e*. Transfer mechanism 228 is cyclically moved with the opening and closing of upper and lower die assemblies 216 and 218 by an appropriate motion controller 229 (e.g. electronically controlled stepping motor, pneumatic or hydraulic drive). In this manner transfer arms 268*a*, 268*b*, 268*c*, 268*d*, and 268*e* are simultaneously activated after each cycle of progressive die 214. Additionally, transfer arm 268*c* and gripper 270*c* include rotational means to rotate partial-finished battery terminal 230*c* 180 degrees.

As shown schematically in FIG. 7, preform station 220 includes a preform station cavity (not shown) located in upper die assembly 216. The preform station cavity includes a preform opening having a diameter which is greater than the outer diameter D10 of lead slug 230*a*. Additionally the preform station cavity terminates at a preform station cavity end. Preform station 220 further includes a preform punch (not shown) located in lower die assembly 218 in alignment with the preform opening in upper die assembly 216. The preform punch has a diameter less than the diameter of the preform opening. When upper die assembly 216 and lower die assembly 218 are activated the preform punch extends beyond the surface of upper die assembly 216 toward the preform station cavity end.

Figure 10A:
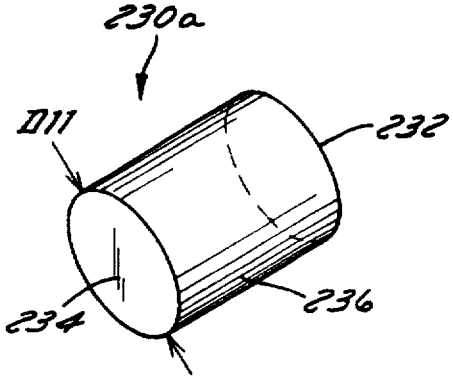
FIG. 10A is an isometric illustration of a lead slug.
Figure 10B:
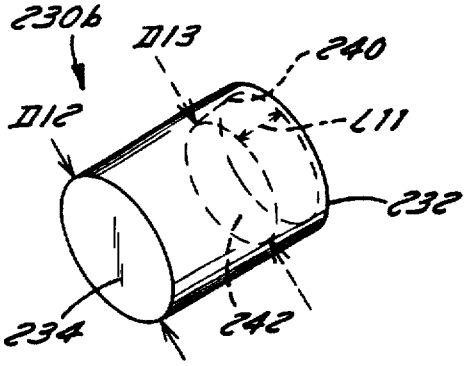
FIG. 10B is an isometric illustration of a pre-formed lead slug.
Figure 10C:
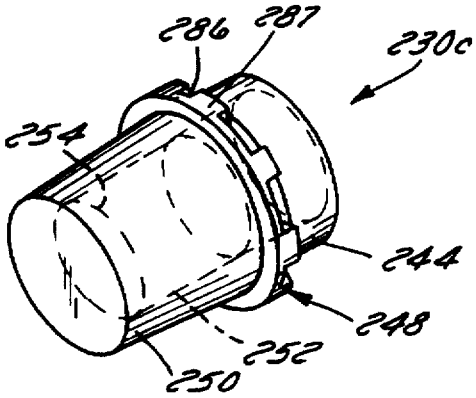
FIG. 10C is an isometric illustration of a partial-finished battery terminal.
Figure 10D:
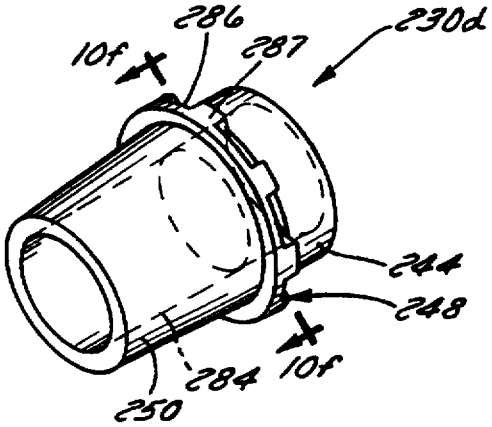
FIG. 10D is an isometric illustration of a near-finished battery terminal.
Figure 10E:
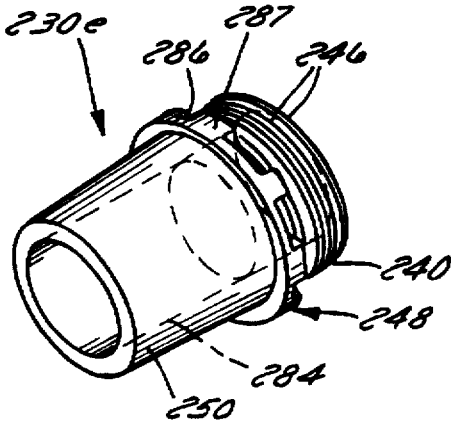
FIG. 10E is an isometric illustration of a rolled battery terminal.
Figure 10F:
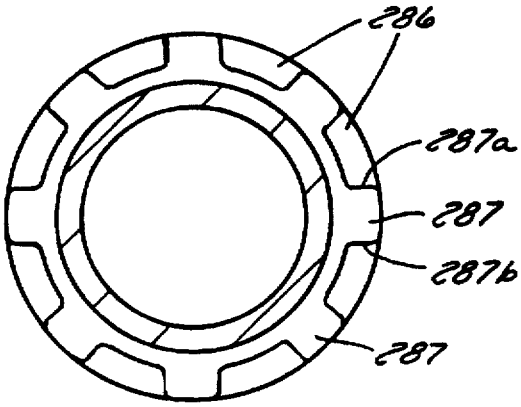
FIG. 10F is a cross-sectional view taken along line 10F—10F of the splined ring of the rolled battery terminal.
Figure 12:
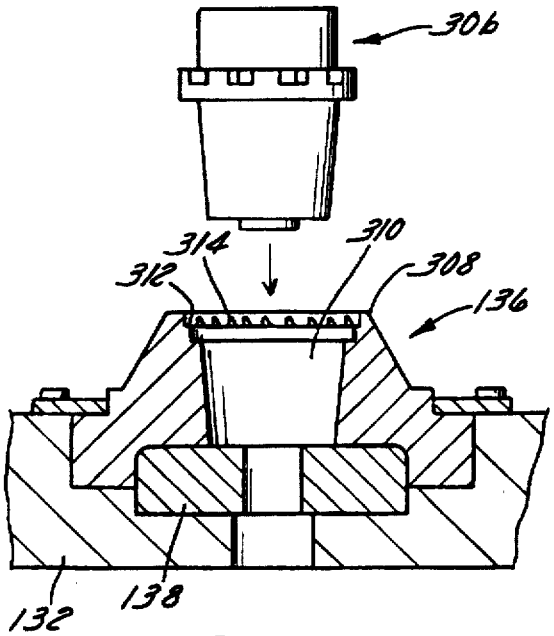
FIG. 12 is a cross sectional view of an index die and a partial-finished battery terminal.

As shown schematically in FIG. 7, the second station in progressive die 214 is partial-finish station 222 which includes a unitary die 280 and forming punch 282 located in lower die assembly 218. In this embodiment unitary die 280 comprises one piece. The lower portion of unitary die 280 is provided with an inner profile configured to form head 244 having a substantially uniform diameter. The upper portion of unitary die 280 has an inner profile configured to form a plurality of splined ring recesses 286 and tabs 287 of the partial-finished battery terminal 230*c* (FIG. 10F). Splined ring tabs 287 are defined by a first wall 287*a* and a second wall 287*b* which are substantially parallel to one another. In contrast, where an apparatus uses a split die to form a battery terminal the walls of some splined ring tabs must be angled to permit the opening of the split die (See FIG. 6F). Partial-finish station 222 further includes a forming cavity located in upper die assembly 216 in alignment with forming punch 282. The forming cavity in upper die assembly 216 has an upper tapered region configured to form frustum 250 of partial-finished battery terminal 230*c*. The forming cavity further includes a lower portion configured to form an upper region of splined ring 248.

Figure 8:
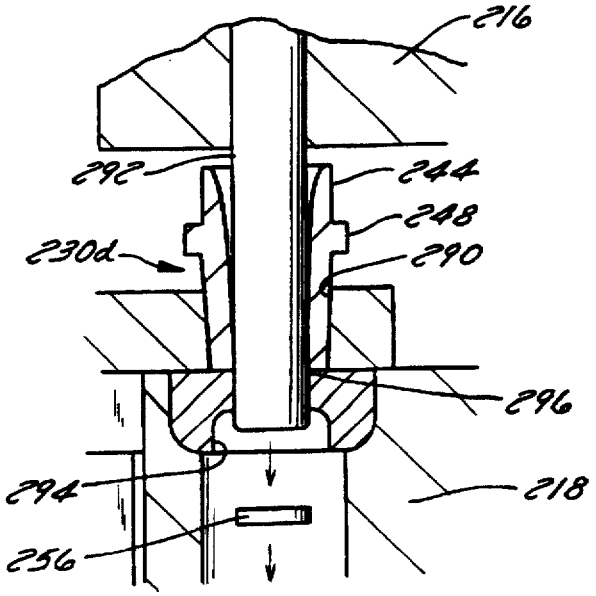
FIG. 8 is a cross-sectional view of the partial-finish station of the alternative embodiment.

Referring to FIG. 8, the third station in progressive die 214 is near-finish station 224 which includes a punching station opening 290 in lower die assembly 218 and a through punch 292 in upper die assembly 216. Lower die assembly 218 further includes an anvil 294 having an anvil aperture 296. Anvil 294 is located in lower die assembly 218 below punching station opening 290.

Figure 9:
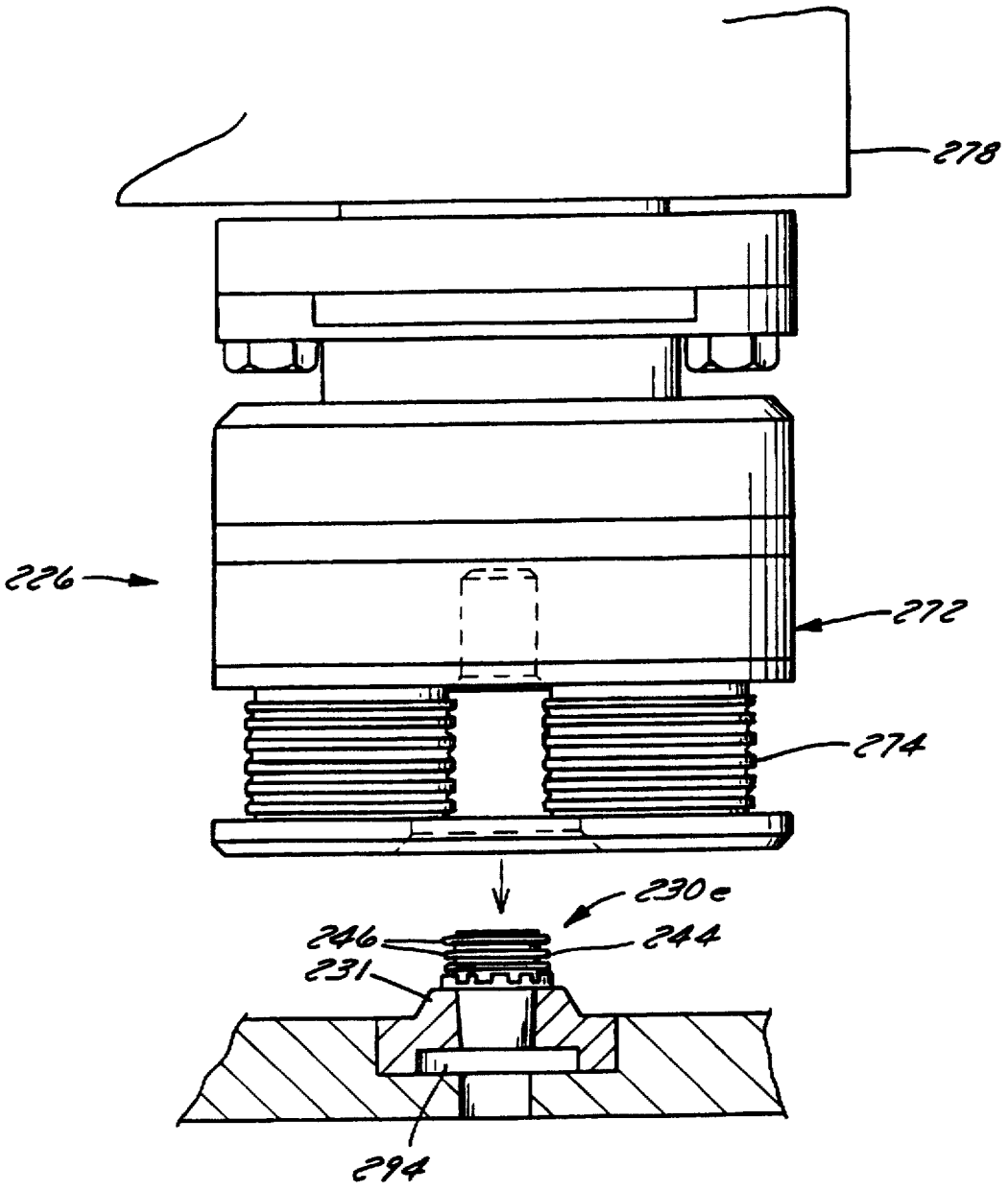
FIG. 9 is a cross-sectional view of the rolling station of the alternative embodiment.

Referring to FIG. 9, the fourth station in progressive die 214 is rolling station 226 which includes a drive assembly 278, a rolling lower die 227 configured to support frustum 250 of near-finished battery terminal 230*d*. Rolling station 226 further includes a ring forming head 272 having three rollers 274. Rollers 274 are configured to create annular rings 246 on head 244 when ring forming head 272 is engaged with near-finished battery terminal 230*d*. In this alternative embodiment ring forming head 272 is of the type manufactured by Fette type Radial Rolling Head E 16 A 00 having three rollers 274 configured to create annular rings 246.

The method of creating a finished battery terminal utilizing apparatus 210 as described above in this alternative embodiment will now be described in greater detail. An elongated cylindrical lead slug 230*a* is first formed (e.g. cut or sheared) from an extruded lead wire 98 in lead slug station 12. Lead slug 230*a* includes a proximal end 232, a distal end 234, an outer diameter D11 and an outer surface 236 (FIG. 10A). Lead slug 230*a* is transferred from lead slug station 12 by means of a transfer mechanism (e.g. guide tube) to indexing turntable 58. Lead slug 230*a* is received in opening 62 where proximal end 232 is supported by base 64. Indexing turntable 58 is rotatably indexed to permit lead slugs 230*a* to be removed by transfer mechanism 228.

Transfer mechanism 228 transfers lead slug 230*a* from indexing turntable 58 to preform station 220 with arm 270*a* and gripper 268*a* and places lead slug proximal end 232 in contact with lower die assembly 218 directly below the preform opening. When progressive die 214 is activated the preform punch creates a lead slug preform cavity 238 (FIG. 10B) extending from proximal end 232 toward distal end 234. In this manner lead slug 230*a* is formed into preform slug 230*b* including an outer diameter D12, and cavity 238 having a cavity wall 240 and a cavity base 242. Additionally, Cavity 238 is defined by a diameter D13 and a depth L11. Also outer-surface 236 is refined such that diameter D12 of preformed slug 230*b* is the same as the diameter of the preform cavity located in upper die assembly 216.

Transfer mechanism 228 transfers pre-formed lead slug 230*b* from pre-form station 220 to partial-finish station 222 with arm 270*b* and gripper 268*b*. Preformed lead slug 230*b* is transferred to partial-finish station 222 such that proximal end 232 having cavity 238 is in contact with lower die assembly 218 and distal end 234 is orientated toward upper die assembly 216.

When progressive die 214 is activated, upper die assembly 216 and lower die assembly 218 come together. Forming punch 282 is subsequently activated extending from lower die assembly 218 into upper die assembly 216 within the upper cavity. In this manner partial-finished battery terminal 230*c* is formed including frustum 250, splined ring 248 having a plurality of splined ring recesses 286 and tabs 287, and head 244 having a substantially uniform diameter (FIG. 10C). Additionally, the partial-finished battery terminal 230*c* includes a tapered recess 252 extending from proximal end 232 toward distal end 234 and concluding at a blank wall 254. As the upper die and lower die assemblies 216, 218 separate, partial-finished battery terminal 230*c* remains in the unitary lower die 280 and is subsequently removed by transfer mechanism 228.

Transfer mechanism 228 transfers partial-finished battery terminal 230*c* from partial-finish station 222 to near-finish station 224 with arm 270*c* and gripper 268*c*. Partial-finished battery terminal 230*c* is rotated 180 degrees by gripper 268*c* from partial-finish station 222 to near-finish station 224. In this manner distal end 234 is positioned in lower die assembly 218 and proximal end 232 is orientated toward upper die assembly 216. When progressive die 214 is activated through punch 292 removes a disc 256 from blank wall 254 forming a continuous tapered recess 284 from proximal end 232 to distal end 234. In this manner a near-finished battery terminal 230*d* is formed. (FIG. 10D).

Transfer mechanism 228 subsequently transfers near-finished battery terminal 230*d* to rolling station 226 with arm 270*d* and gripper 268*d*. Near-finished battery terminal 230*d* is positioned in a rolling lower die 231, having the form of frustum 250 of partial-finished battery terminal 230*d*. When progressive die 214 is activated ring forming head 272 engages head 244. Rollers 274 are initially positioned such that the flat portion 276 of rollers 274 are facing head 244. Ring forming head 272 is rotated by drive assembly 278 such that rollers 274 are rotated once thereby engaging head 244 and cold forming annular rings 246. At the completion of the rotation the flat roller surface 276 is once again facing head 244 permitting the removal of ring forming head 272 at the end of the cycle. In this manner a finished rolled battery terminal 230*e* is formed having annular rings 246 (FIG. 10E). The diameter of head 244 of the near-finished battery terminal 230*c* is modified as a result of the engagement and rotation of the ring forming head 72. Annular rings 246 are formed not by removing material from head 244 but rather by the flowing of material. Additionally, in contrast to a battery terminal formed with a split die, the finished rolled battery terminal 230*e* is formed without a flash line along the longitudinal axis of the battery terminal.

Transfer mechanism 228 subsequently transfers finished battery terminal 230*e* to drop station 26 with arm 268*e* and gripper 270*e*.

As described above with each cycle of the progressive die 214, arm 268*a* and gripper 270*a* transfer lead slug 230*a* from pickup station 12 to pre-form station 220, arm 268*b* and gripper 270*b* transfer pre-formed lead slug 230*b* from pre-form station 220 to partial-finish forming station 222, arm 268*c* and gripper 270*c* transfer partial-finished battery terminal 230*c* from partial-finish station 222 to near-finish station 224, arm 268*d* and gripper 270*d* transfer near-finished battery terminal 230*d* from near-finish station 224 to rolling station 226, and arm 268*e* and gripper 270*e* transfer rolling battery terminal 230*e* from rolling station 226 to drop station 26.

In another embodiment, progressive die 214 includes only three stations, a partial-finish station 222, a near-finish station 224, and a rolling station 226. In this embodiment, lead slug 230*a* is transferred directly to partial-finish station 222.

As described in the preferred embodiment above with respect to apparatus 10, a seating station may also be employed in the alternative embodiments utilizing progressive die 214. The seating station would be similar to seating station 300 described above. However the seating station would be an additional station in the progressive die located before radial rolling station 226. Additionally, as described above in apparatus 10, radial rolling station 226 may be located prior to near-finish station 224. In this manner radial rings 246 would be formed prior to the formation of through hole defined by continuous tapered recess 252.

Indents 306 have been discussed above in reference to the formation of a battery terminal 30*d*. However, indents 306 also provide an improved anti-torque arrangement.

Figure 15:
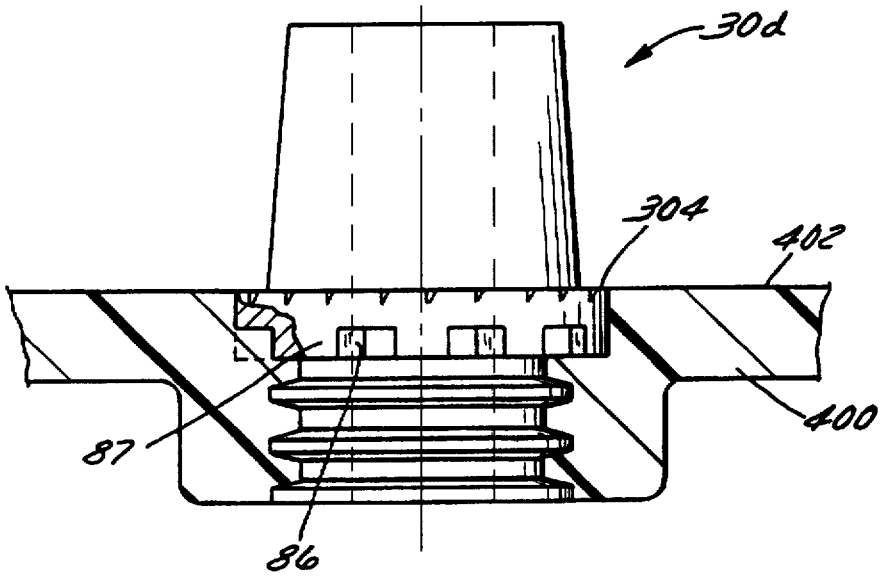
FIG. 15 is a cross sectional view of a finished battery terminal integrally molded into a battery housing.
Figure 16:
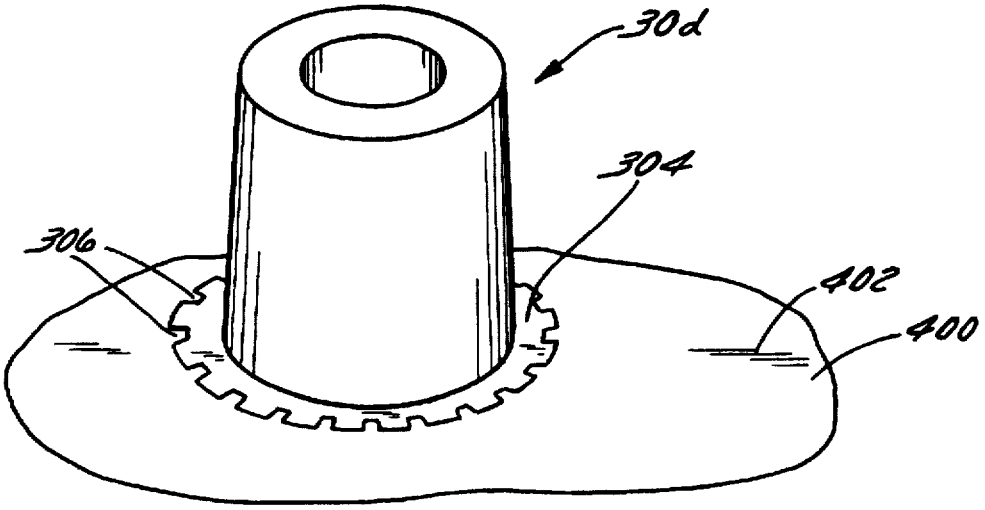
FIG. 16 is an isometric view of a finished battery terminal integrally molded into a battery housing.

Referring to FIGS. 15 and 16, terminal 30*d* is shown integrally molded with a portion of a housing 400 of a battery (e.g. lead acid car battery) having an exterior surface 402. Typically, the combination of recesses 86 and tabs 87 prevent rotation of terminal 30*d* relative to housing 400 about the terminal axis. However, when terminal 30*d* is molded into housing 400, the material (e.g., plastic) of exterior surface 402 can be molded to flow into indents 306 as shown in FIG. 16. This engagement of the housing with indents 306 increases the ability of terminal 30*d* to resist rotation about the axis.

Regardless of the shape of the portion of the terminal which is used for electrical connection at the exterior of the battery (e.g., frusto-conical, L-shape, threaded side terminal), the use of indents 306 whether shaped as shown herein or otherwise inhibits terminal rotation relative to the battery housing when engaged with the housing. Depending upon the application it may be desirable to use indents 306 on an upper surface 304 above or in combination with another formation (e.g., recesses 86 and tabs 87) to provide an anti-torque structure for a battery terminal.

Although the invention has been described in conjunction with specific embodiments thereof, it is evident that alternatives, modifications and variations will be apparent to those skilled in the art. For example ring forming head may create a single ring 46 or a plurality of rings 46 on the head 44. The ring forming head may also cold form other patterns on head 44 such as a knurled pattern. Additionally, drive assembly 78 may rotate head 44 relative to radial forming head 72. In the alternative embodiment the transfer mechanism 28 may comprise up to five separate devices. The preferred embodiment may include a preform station, and the alternative embodiment may not have a preform station.

Additionally, lead slug station 12 may include an in line indexing device in place of a circular index plate 60. Further forming station 20 may be modified such that upper die 16 may be configured to form indents 306 or a similar locating feature in the upper surface 304 of spline 48. In this manner, the formation of indents would be accomplished in the forming station instead of seating station 300. Also it is possible that a projection may be formed on battery terminal 30*b* that is positively located within a depression within die 136. Further, a mechanical assembly may be utilized such that recesses 86 and tabs 87 of splined ring 48 are positively engaged proximate die 136.

Figure 17:
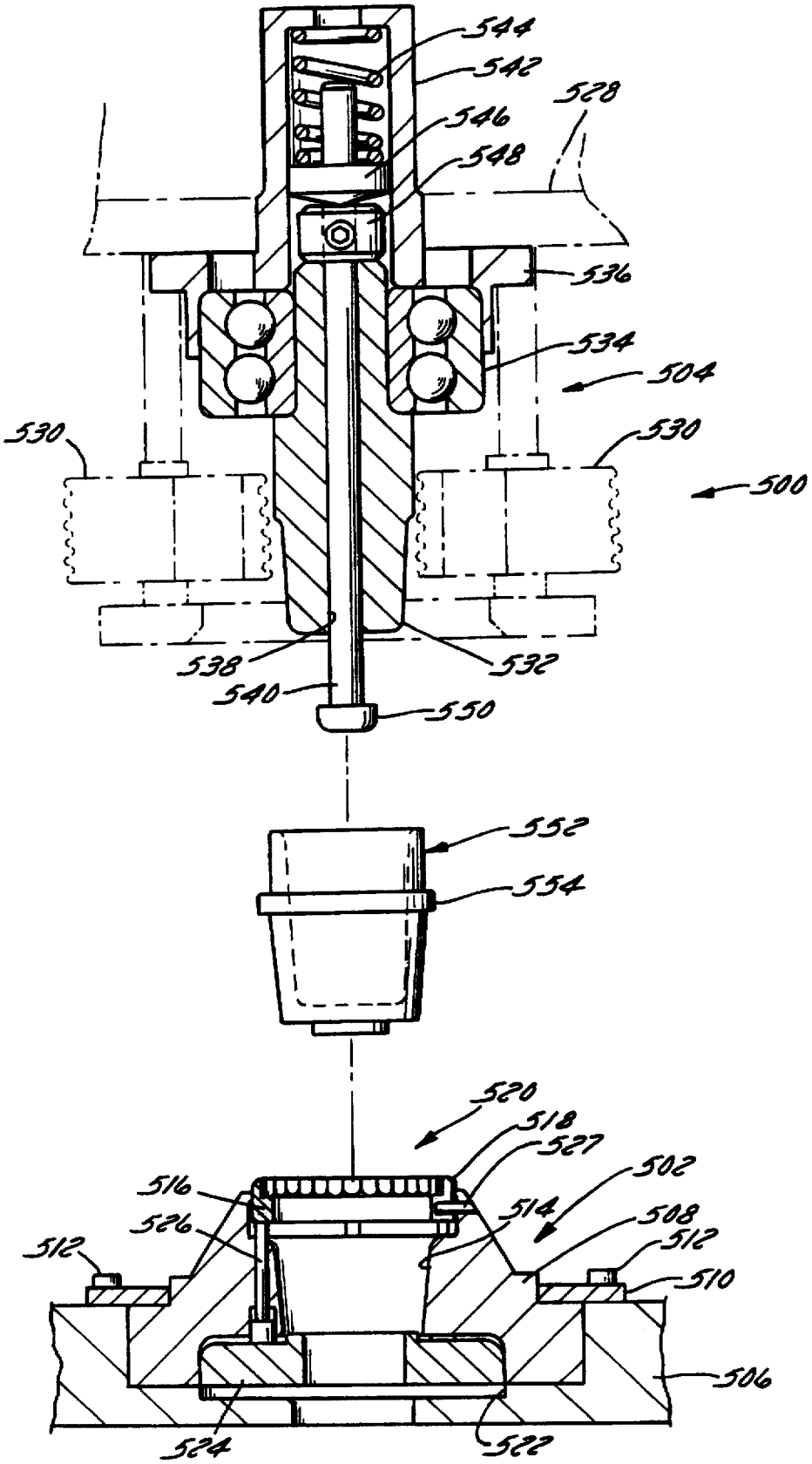
FIG. 17 is a cross sectional side view of a second alternative embodiment of an apparatus for holding a partially formed battery terminal while roll forming annular rings on a portion of the outer surface, with the upper and lower portions of the apparatus separated and showing the partially formed battery terminal positioned therebetween.
Figure 18:
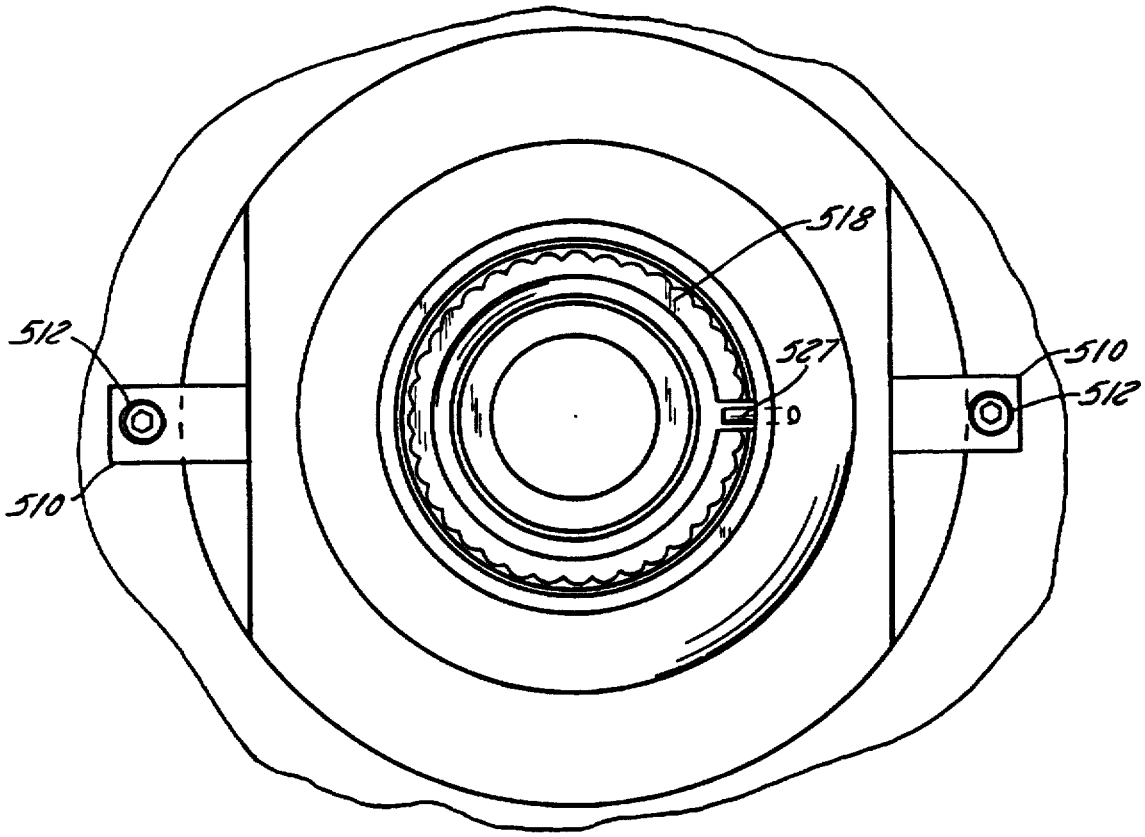
FIG. 18 is a top plan view of the lower portion of the apparatus shown in FIG. 17.

A second alternative or third embodiment of the method and apparatus for holding and roll forming annular rings on a battery terminal will be described by making reference to FIGS. 17–23. As shown in FIG. 17, the apparatus 500 in accordance with the third embodiment includes a lower portion 502 and an upper portion 504. Positioned between the lower portion 502 and the upper portion 504 is a partially formed battery terminal around a portion of the outer surface of which are to be roll formed annular rings. The lower portion includes a base member 506, which supports a die 508, which is clamped thereto by an annular ring 510, which is secured to the base member 506 by a plurality of fasteners 512.

The die 508 has an annular bore 514 therein which has an enlarged diameter portion 516 at the top which receives a split ring 518. The split ring 518 has serrations 520 formed around its inner surface. The annular bore 514 is provided with a second enlarged diameter portion 522 in which is received a ring member 524. The ring member 524 is connected, for reciprocating vertical movement, to the split ring 518 by a plurality of rods 526, which are received in bores in the die 508. The ends of rods 526 rest against ring member 524 and the split ring 518. Ring member 524 and split ring 518, move in unison in the vertical direction with respect to the die 508. That is, when split ring 518 is pushed down, so is ring member 524 by rods 526. Similarly, when ring member 524 is pushed up, so is split ring 518 by rods 526. In a preferred construction of this third embodiment, six rods 526 spaced 60 degrees apart are provided. The split ring 518 is prevented from rotating with respect to the die 508 by a pin 527 which extends inwardly from the die 508 into a vertical slot in the split ring 518.

The upper portion 504 of the apparatus 500 includes a support portion 528 shown in dashed lines which supports radial rolling heads 530 which are similar to those shown in the previously described embodiments. Also supported by the support portion 528 is a plug member 532. The plug member 532 is supported for rotation with respect to the support portion 528 by a ball bearing assembly 534, the outer race of which is secured to the support portion 528 by a clamping ring 536. A bore 538 is provided in plug member 532 for receiving a rod 540 for reciprocation therein. A cup shaped retainer 542 supported in a hole in support portion 528 receives a coil spring 544 which exerts a downward force on rod 540 through a cup 546 and a ring 548 which is secured to the rod. The lower end of the rod is provided with a head 550 which engages the inside surface of the bottom of a partially formed battery terminal 552.

Figure 19:
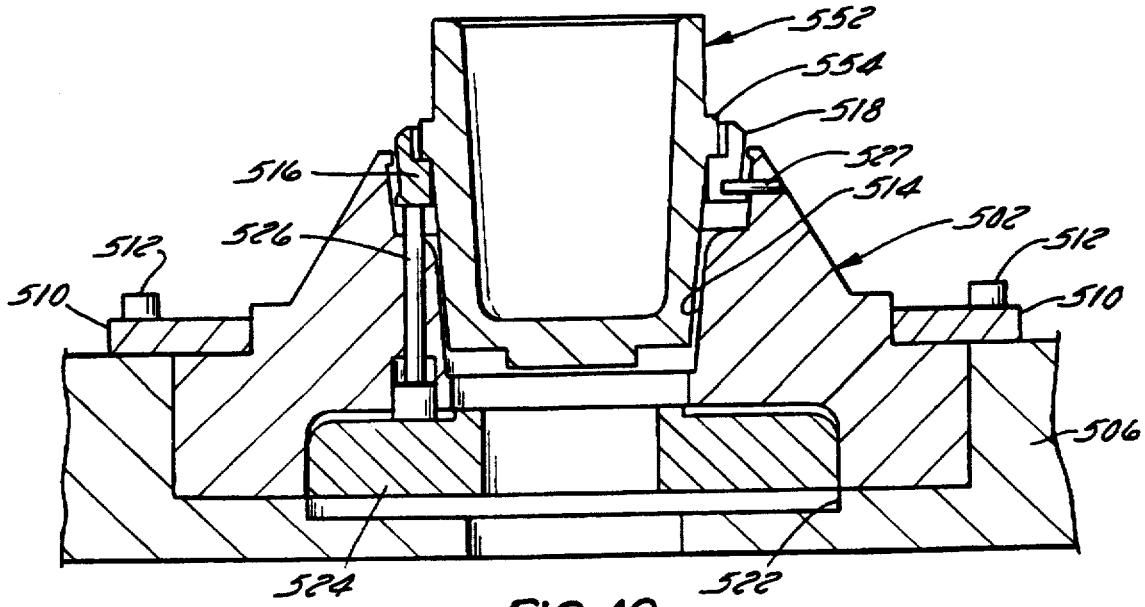
FIG. 19 is an enlarged side view of the lower portion of the apparatus shown in FIG. 17, with the partially formed battery terminal positioned therein.
Figure 20:
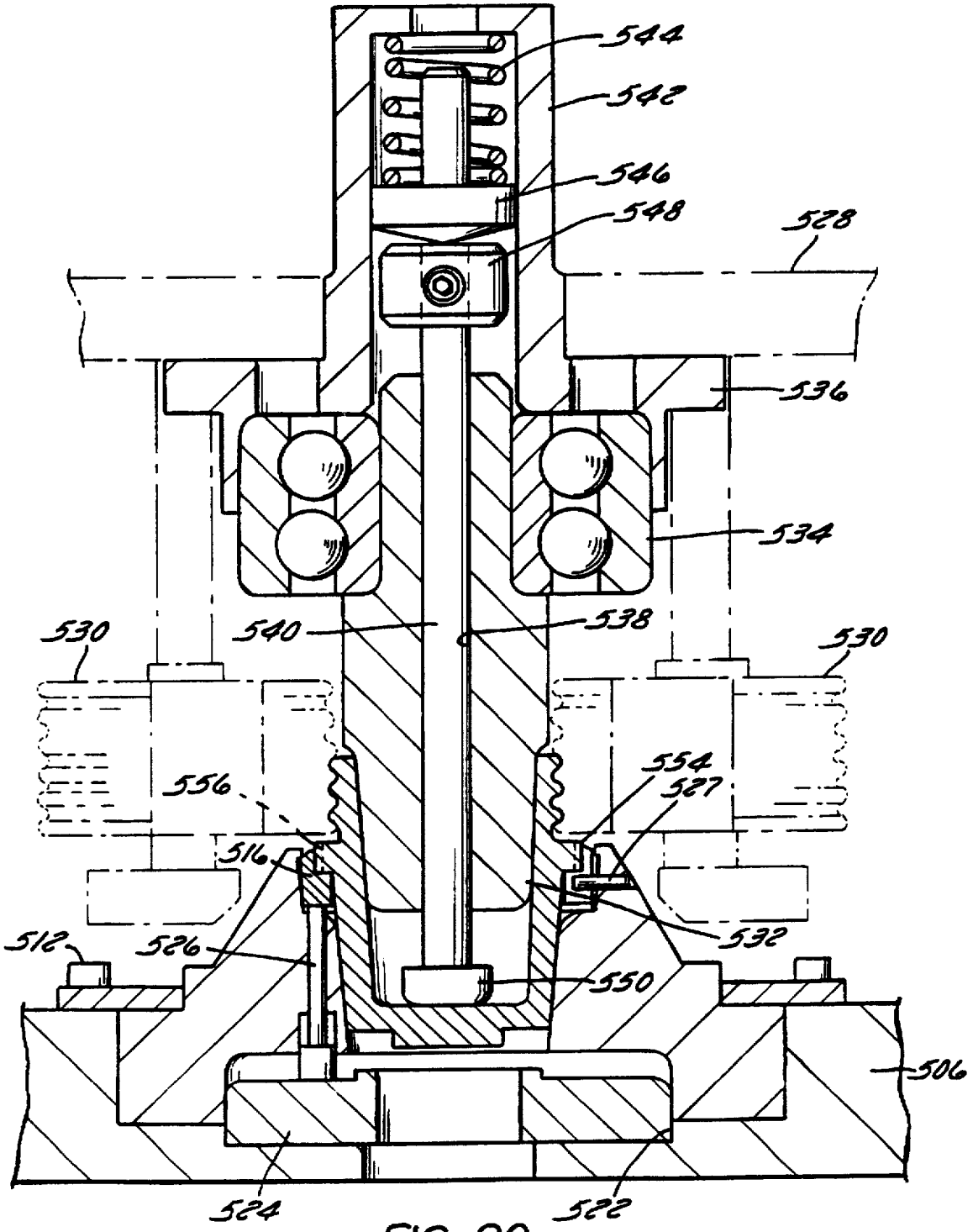
FIG. 20 is a cross sectional side view of a second alternative embodiment similar to FIG. 17, showing the lower and upper portions of the apparatus positioned hold and roll form annular rings on the partially formed battery terminal.
Figure 21:
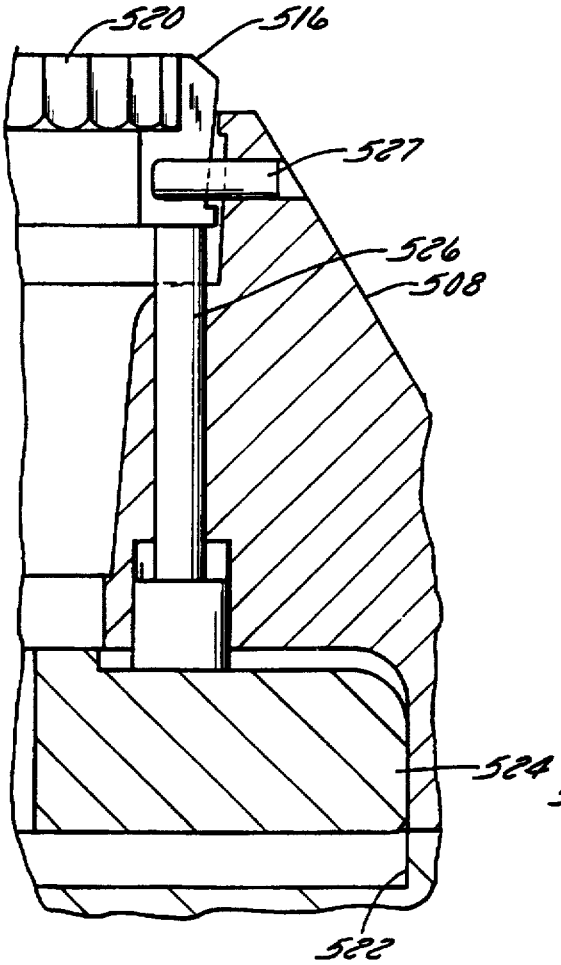
FIG. 21 is an enlarged cross-sectional view of the operating mechanism of the lower portion of the apparatus of FIG. 17, as it initially engages the partially formed battery terminal.
Figure 22:
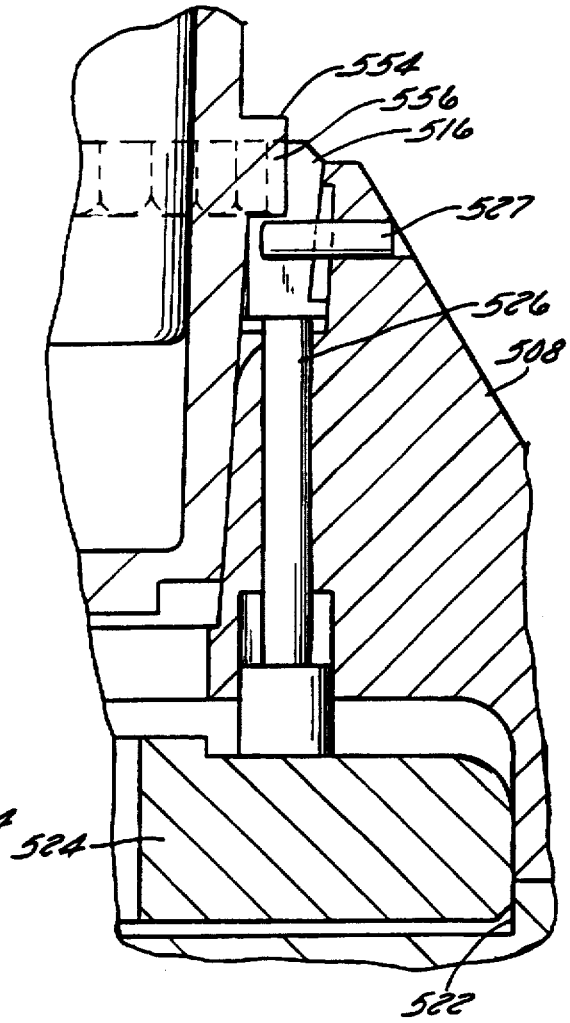
FIG. 22 is an enlarge cross-sectional view similar to FIG. 21, with the operating mechanism of the lower portion engaged with the partially formed battery terminal so as to form serrations in a ring around the outer surface of the partially formed battery terminal.
Figure 23:
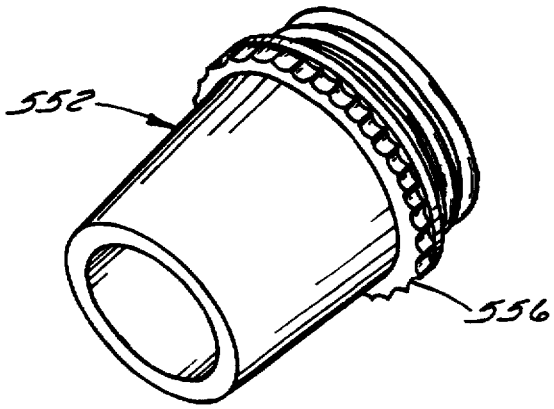
FIG. 23 is a perspective view of the battery terminal after it has been formed with a ring of serrations and roll formed annular rings by the apparatus shown in FIGS. 17–22.
Figure 25:
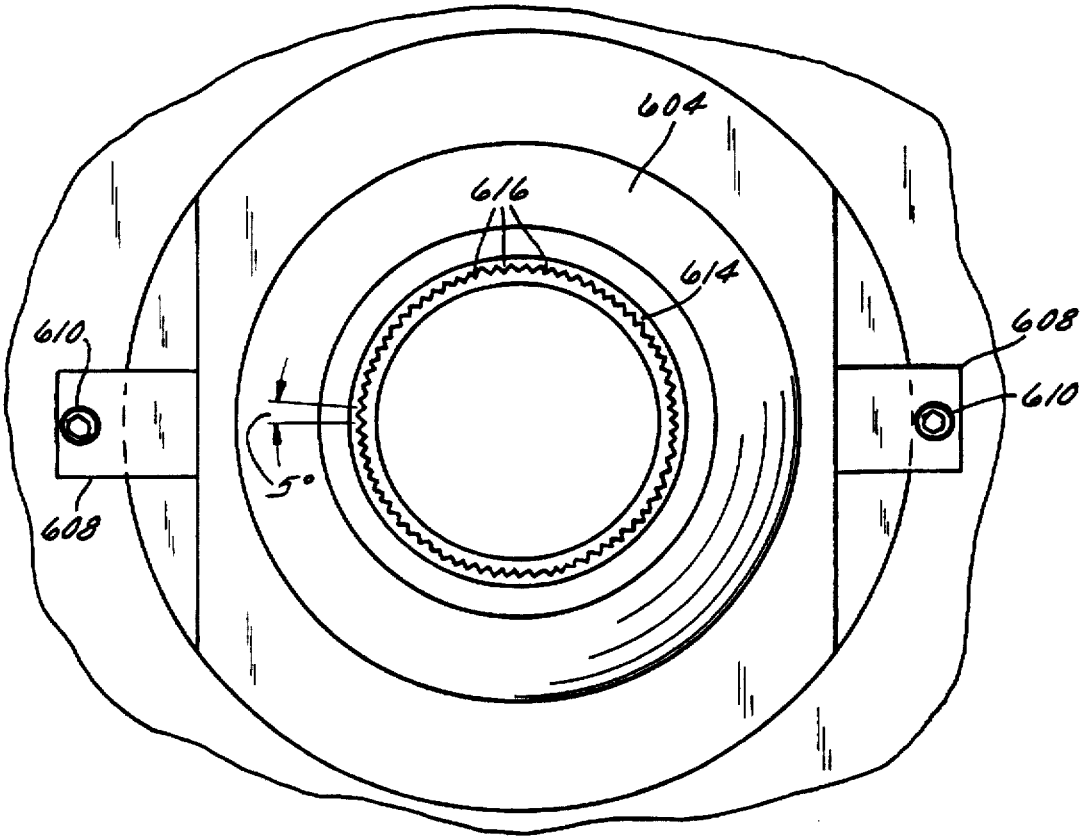
FIG. 25 is a top plan view of the lower portion of the third alternative embodiment apparatus shown in FIG. 24.
Figure 24:
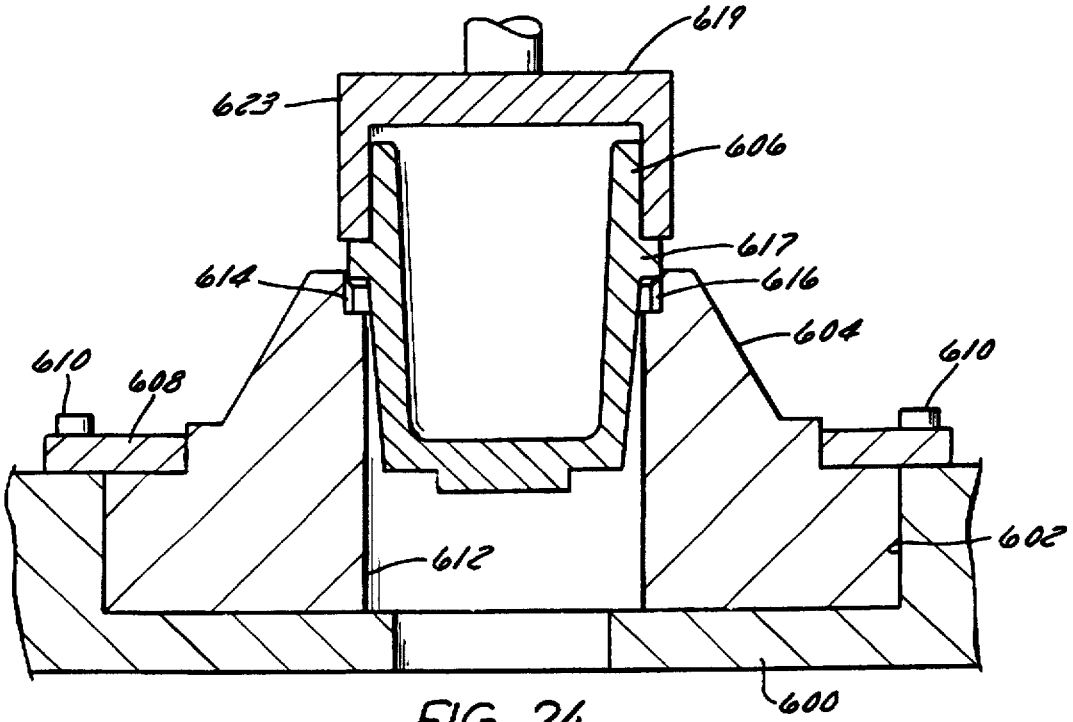
FIG. 24 is a cross sectional side view of the lower portion of a third alternative embodiment of an apparatus for holding a partially formed battery terminal while roll forming annular rings on a portion of the outer surface, with a partially formed battery terminal positioned therein.

The method of holding a partially formed battery terminal for roll forming annular rings thereon in accordance with the second alternative embodiment will now be described with reference to FIGS. 17–23. As shown in FIGS. 19 and 21, a partially formed battery terminal 552 is placed in the lower portion 502 of the apparatus, with the bottom surface of an enlarged ring formed on the outer surface of the partially formed battery terminal, which enlarged ring is to be formed as a splined ring 554, resting on a shelve formed in split ring 518, and the outer surface of the enlarged ring aligned with, but spaced from the serrations 520. As the upper portion 504 is moved toward the lower portion 502, the plug 532 engages the sidewall of the bore in the partially formed battery terminal and forces it downward with respect to the die 508 of the lower portion. The engagement of the enlarged ring on the partially formed battery terminal with the shelve formed in the split ring 518, also forces the split ring downward with respect to the die 508. The split ring 518 is located in an aperture in the die 508, which is conical in form, being smaller in diameter at the bottom. Thus, forcing the split ring 518 downward in the conical aperture causing it to be compressed against the enlarged ring on the partially formed battery terminal, pressing the serrations 520 on the inside surface of split ring 518 into the outer surface of the enlarged ring, so as to create mating serrations 556 therein, thus forming splined ring 554 from the enlarged ring, as shown in FIGS. 20 and 22.

The engagement of the serrations 520 on the split ring 554 with the serration 556 formed on the partially formed battery terminal prevents turning of the partially formed battery terminal as the radial rolling heads 530 form annular rings on the partially formed battery terminal.

Following formation of the annular rings, the upper portion 504 is moved upward, away from the lower portion 502. As upper portion 504 is move upward, a downward force is exerted on rod 540 on the inside surface of the bottom of partially formed battery terminal 552. In this manner partially formed battery terminal 552 remains positively seated in die 508 as plug 532 is disengaged from the battery terminal.

In a particular application of this third embodiment, the conical aperture in the die in which the split ring 518 is located has a taper of 5 degrees. The engaging outer surface of the collet split ring 518 is also provided with a conical surface having a taper of 5 degrees, being larger in diameter at the top than at the bottom. Thus, the facing surfaces of the split ring 518 and the conical aperture in the die are parallel with each other. While the preferred taper is 5 degrees, tapers in the range of 3 to 7 degrees have been found to provide acceptable performance.

The serrations formed in the split ring 518 have a depth of 0.015 inches and each span 5 degrees of the circumference of the ring, thus providing seventy-two serrations. While the just recited serration depth and span are preferred, other depths and spans, which provide adequate resistance to rotation of the partially formed battery terminal 552, could be used in accordance with this invention.

Referring to FIGS. 24–27, a third alternative or fourth embodiment of an apparatus for holding a partially formed battery terminal while roll forming annular rings on a portion of the outer surface will be described. In accordance with this embodiment, a base member 600 is provided with a countersunk hole 602 for receiving an annular member 604 which supports a partially formed battery terminal 606. The annular member 604 is secured to the base member 600 by a ring 608 which is secured to the base member 600 by a plurality of fasteners 610. The annular member 604 has a central bore 612, which is provided with a countersunk larger diameter bore 614, the periphery of which is formed as a plurality of serrations 616.

In accordance with this embodiment of the invention, a partially formed battery terminal 606, similar to the partially formed battery terminal 552 of the previous embodiment, is placed in the central bore 612, with the bottom surface of enlarged ring 617 resting on the top surfaces of the serrations 616. A pressing tool 619 is lowered into engagement with the enlarged ring 617 of the partially formed battery terminal 606. (See FIG. 24). As increased downward force is applied to the tool 619, the enlarged ring 617 is pushed into the serrations 616, thus forming complementary serrations 618 in the enlarged ring 617 so as to form a serrated ring 625.

Figure 27:
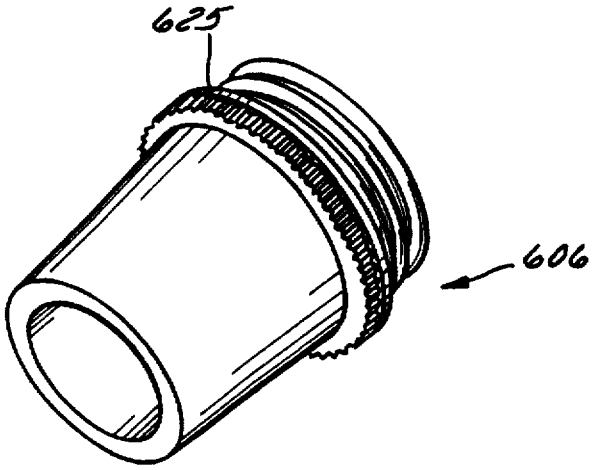
FIG. 27 is a perspective view of the partially formed battery terminal provided with roll formed annular rings by the apparatus of FIGS. 24–26.
Figure 26:
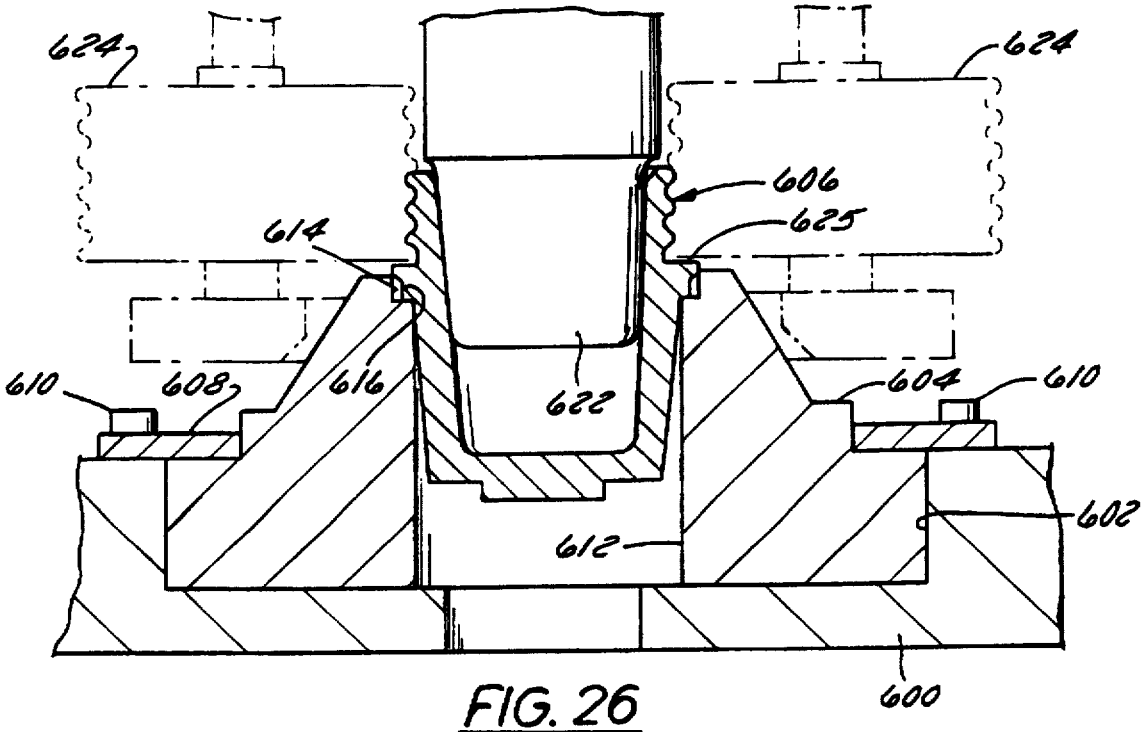
FIG. 26 is a cross sectional side view similar to FIG. 24, showing the upper portion of the apparatus of the third alternative embodiment roll forming annular rings on a portion of the outer surface of a partially formed battery terminal held by the lower portion of the apparatus.

With a partially formed battery terminal positioned in the annular member 604 of the lower portion of the apparatus, in a further step of forming a battery terminal, the lower and upper portions of the apparatus are moved toward each other, with a plug 622 of the upper portion engaging the partially formed battery terminal 606 to hold it in the annular member 604. With the engagement of the serrations 616 and 618 preventing rotation of the partially formed battery terminal 606, radial rolling heads 624 engage the terminal 606 to form annular rings thereon as shown in FIG. 27. Again, the presence of snug fitting plug 622 in the bore of the partially formed battery terminal 606, prevents deformation of bore of the terminal 606 during formation of the annular rings.

It is intended that the claims embrace all of the above described and other alternatives, modifications and variations which fall within the spirit and scope of the appended claims.

What is claimed is:

1. An apparatus for securely seating a lead battery terminal in a die to prevent the lead battery terminal from rotating within the die, the apparatus comprising:

a fixture including a die having a recess configured to receive the battery terminal, and a serrated inner surface proximate the recess configured to engage the battery terminal to prevent rotation of the battery terminal within the die.

2. The apparatus of claim 1, further including a moveable punch located above the fixture to force the battery terminal onto the serrated inner surface.

3. The apparatus of claim 2, wherein the punch is formed from a plastic material.

4. The apparatus of claim 1, wherein the serrated inner surface has a tapered form configured to create a depression in the battery terminal.

5. The apparatus of claim 4, wherein the die includes a top surface, and a radial surface located within a tapered recess a set distance from the top surface, the serrated inner surface extending from the radial surface toward the top surface.

6. The apparatus of claim 5, wherein the die includes a plurality of serrations extending from the radial surface toward the top surface.

7. An apparatus for securely seating a lead battery terminal in a die to prevent the lead battery terminal from rotating within the die, the apparatus comprising:

a fixture including a die having a recess configured to receive the battery terminal, and at least one projection located proximate the recess configured to engage the battery terminal to prevent rotation of the battery terminal within the die, wherein a ring is supported on the die, the ring having a serrated inner surface which engages serrations on the outer surface of the battery terminal to prevent rotation of the battery terminal with respect to the die.

8. The apparatus of claim 7, wherein the serrated inner surface of the ring is pressed into the outer surface of the battery terminal to form serration therein.

9. The apparatus of claim 8 wherein a camming structure provided between the die and the ring forces the serrations of the ring into the outer surface of the battery terminal to form serrations therein.

10. The apparatus of claim 8, wherein a retention member secured to the ring engages the die to retain and separate the ring from the terminal when the terminal is removed from the die.

11. The apparatus of claim 7, wherein a plug movable with respect to the die pushes the battery terminal into engagement with the die.

12. The apparatus of claim 11, wherein a spring biased member associated with the plug applies a force to separate the plug from the terminal.

13. An apparatus for forming rings on a battery terminal without substantially removing material from the battery terminal, the apparatus comprising:

a station configured to securely position the battery terminal within a fixture;

a rolling station including a cold metal forming member configured to form rings on the outer surface of the battery terminal when the terminal and cold metal forming member are rotated relative to each other; and a drive assembly configured to rotate the terminal and cold metal forming member relative to each other.

14. The apparatus of claim 13, wherein the fixture includes a die having a recess configured to receive the battery terminal, and at least one projection located proximate the recess configured to engage the battery terminal to prevent rotation of the battery terminal within the die.

15. The apparatus of claim 14, wherein the die includes a top surface, and a radial surface located within the recess a set distance from the top surface, at least one projection extending from the radial surface toward the top surface.

16. The apparatus of claim 13, wherein the cold metal forming member is at least one roller.

17. The apparatus of claim 13, wherein the cold metal forming member is a plurality of rollers.

18. An apparatus for forming rings on a lead battery terminal, the apparatus comprising:

a seating station configured to securely position the battery terminal within a fixture;

a rolling station including a ring forming head configured to form rings on the lead battery terminal when the terminal and ring forming head are rotated relative to each other; and a drive assembly fastened to the fixture and head to rotate the terminal and ring forming head relative to each other, the fixture including a die having a recess configured to receive the battery terminal, and at least one projection located proximate the recess configured to engage the battery terminal to prevent rotation of the battery terminal within the die, wherein the seating station includes a moveable seating punch located above the fixture to engage the battery terminal with the at least one projection.

19. An apparatus for forming rings on a lead battery terminal, the apparatus comprising:

a seating station configured to securely position the battery terminal within a fixture;

a rolling station including a ring forming head configured to form rings on the lead battery terminal when the terminal and ring forming head are rotated relative to each other; and a drive assembly fastened to the fixture and head to rotate the terminal and ring forming head relative to each other, the fixture including a die having a recess configured to receive the battery terminal, and at least one projection located proximate the recess configured to engage the battery terminal to prevent rotation of the battery terminal within the die, the die including a top surface, and a radial surface located within the recess a set distance from the top surface, the at least one projection extending from the radial surface toward the top surface, wherein the die includes a plurality of projections extending from the radial surface toward the top surface.

20. An apparatus for forming rings on a lead battery terminal, the apparatus comprising:

a seating station configured to securely position the battery terminal within a fixture;

a rolling station including a ring forming head configured to form rings on the lead battery terminal when the terminal and ring forming head are rotated relative to each other; and a drive assembly fastened to the fixture and head to rotate the terminal and ring forming head relative to each other, wherein the ring forming head includes a plurality of rollers each having a flat portion, wherein the rollers are configured to form a ring on the lead battery terminal.

21. The apparatus of claim 20, wherein the rollers are configured to form a plurality of parallel rings on the lead battery terminal.

22. A method for forming a ring on a lead battery terminal, the method comprising the steps of:

securing the lead battery terminal within a fixture;

engaging a cold metal forming member with the outer surface of the lead battery terminal while the cold metal forming member and the lead battery terminal are rotating relative to each other; and forming a ring on the lead battery terminal, without substantially removing any material.

23. The method of claim 22, wherein the step of securing includes seating the battery terminal within a die located within the fixture.

24. The method of claim 22, wherein the step of engaging a cold metal forming member includes engaging at least one roller with the battery terminal.

25. The method of claim 24, wherein the step of engaging at least one roller includes engaging three rollers.

26. A method for forming a ring on a lead battery terminal, the method comprising the steps of:

securing the lead battery terminal within a fixture: and engaging a ring forming head with the lead battery terminal while the rolling head and the lead battery terminal are rotating relative to each other, the step of securing includes seating the battery terminal within a die located within the fixture, wherein the step of seating includes forming at least one depression on the battery terminal on a projection located in the die.

27. A method for forming a ring on a lead battery terminal, the method comprising the steps of:

securing the lead battery terminal within a fixture; and engaging a ring forming head with the lead battery terminal while the rolling head and the lead battery terminal are rotating relative to each other, the step of securing includes seating the battery terminal within a die located within the fixture, wherein the step of seating includes forming a plurality of depressions on the battery terminal on a plurality of projections located in the die.

28. The method of claim 23, wherein the step of engaging a cold metal forming member includes engaging a plurality of rolling head rollers with the lead battery terminal forming a ring on the lead battery terminal.

29. The method of claim 28, further comprising the step of rotating the rolling head rollers and lead battery terminal relative to each other forming a ring on the lead battery terminal.

* * * * *